US012742305B2

(12) United States Patent
Wakata

(10) Patent No.: US 12,742,305 B2
(45) Date of Patent: Sep. 22, 2026

(54) WORK MACHINE

(71) Applicant: Yanmar Holdings Co., Ltd., Osaka (JP)

(72) Inventor: Tatsumasa Wakata, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 276 days.

(21) Appl. No.: 18/440,934

(22) Filed: Feb. 13, 2024

(65) Prior Publication Data

US 2024/0318405 A1 Sep. 26, 2024

(30) Foreign Application Priority Data

Mar. 24, 2023 (JP) ..... 2023-048402

(51) Int. Cl.
*E02F 9/08* (2006.01)

(52) U.S. Cl.
CPC ..... *E02F 9/0866* (2013.01)

(58) Field of Classification Search
CPC . E02F 9/0866; E02F 3/325; E02F 9/16; F02B 63/042; F01N 3/021; F01N 3/24; F01P 5/02; B60Y 2200/412; Y02A 50/20
See application file for complete search history.

(56) References Cited

U.S. PATENT DOCUMENTS 7,829,048 B1 * 11/2010 Gonze ..... B01D 53/9454 423/213.2
8,181,452 B2 * 5/2012 Bidner ..... F02D 41/029 60/296
8,407,988 B2 * 4/2013 Bidner ..... F02D 41/0002 60/297
8,424,295 B2 * 4/2013 Bidner ..... F01N 3/023 60/297
8,438,840 B2 * 5/2013 Bidner ..... F02M 26/47 60/285
8,438,841 B2 * 5/2013 Bidner ..... F01N 3/023 60/285
2011/0030344 A1 * 2/2011 Gonze ..... F01N 3/2013 60/274
2012/0304887 A1 * 12/2012 Gokhale ..... F02M 26/43 105/62.1

(Continued)

FOREIGN PATENT DOCUMENTS

JP 2014031783 A 2/2014
JP 6900336 B2 7/2021

(Continued)

OTHER PUBLICATIONS

Notice of Reasons for Refusal: Japanese Patent Application No. 2023-048402, Date: Dec. 26, 2025.

*Primary Examiner* — Joseph J Dallo
(74) *Attorney, Agent, or Firm* — Chris Mizumoto

(57) ABSTRACT

A work machine includes an engine having an output shaft projecting to one side in a lateral direction of a machine body, a hydraulic pump disposed on the other side in the lateral direction of the engine, an exhaust gas purification device disposed above the engine and treating exhaust gas discharged from the engine, and an alternator driven by rotational power of the output shaft. The alternator is disposed at a position behind the engine and below the exhaust gas purification device.

7 Claims, 14 Drawing Sheets

(56) References Cited

U.S. PATENT DOCUMENTS

| | | | | |
|---|---|---|---|---|
| 2015/0322848 | A1* | 11/2015 | Gokhale | F01N 3/2053 60/602 |
| 2016/0090902 | A1* | 3/2016 | Svihla | F02B 37/007 60/599 |
| 2018/0009305 | A1* | 1/2018 | Nelson | F02B 73/00 |
| 2018/0058285 | A1* | 3/2018 | Jozsa | F02D 41/024 |
| 2019/0003379 | A1* | 1/2019 | Kemmerling | F02M 26/08 |
| 2019/0234272 | A1* | 8/2019 | Harmsen | F01N 9/00 |
| 2020/0271046 | A1* | 8/2020 | Kelly | F02B 37/10 |
| 2022/0364488 | A1* | 11/2022 | Stoltz | B60L 1/02 |
| 2024/0401515 | A1* | 12/2024 | Hojo | F01P 5/04 |

FOREIGN PATENT DOCUMENTS

| | | | | |
|---|---|---|---|---|
| JP | 6962872 | B2 | 11/2021 | |
| WO | WO-2019115891 | A1 * | 6/2019 | F01N 3/106 |
| WO | WO-2019168150 | A1 * | 9/2019 | F16H 7/12 |
| WO | WO-2020174484 | A1 * | 9/2020 | F01N 13/1811 |
| WO | WO-2021220299 | A1 * | 11/2021 | F01N 3/2892 |

* cited by examiner

WORK MACHINE

CROSS-REFERENCE

This application claims foreign priority of JP2023-048402 filed Mar. 24, 2023, the disclosure of which is hereby incorporated by reference in its entirety.

TECHNICAL FIELD

The present disclosure relates to a work machine including an alternator that is driven by power of an engine to generate electric power.

BACKGROUND ART

In general, work machines including an alternator that is driven by power of an engine to generate electric power have been used (for example, refer to Patent Document 1).

Patent Document 1 discloses a configuration of a backhoe, which is a type of work machine, in which an engine is mounted inside a hood having an opening/closing cover that can be opened rearward in a direction in which an axial direction of an output shaft is a lateral direction of a machine body, a compressor for an air conditioner is disposed on an upper portion of a side surface of the engine on an output shaft side, and the alternator is disposed at a position below the compressor and rearward of the output shaft. The configuration disclosed in Patent Document 1 is made to facilitate access to the alternator and the compressor from a rear side of the hood to obtain excellent maintainability of these devices.

Meanwhile, some work machines, such as backhoes, have an exhaust treatment device for an engine. The exhaust treatment device includes, for example, a diesel particulate filter (DPF) case as a DPF, and is configured to introduce exhaust gas, which is combustion gas discharged from the engine, into the DPF case to purify the exhaust gas. The DPF case is configured as, for example, a substantially cylindrical case.

PRIOR ART DOCUMENT

Patent Document

Patent Document 1: Japanese Unexamined Patent Application Publication No. 2014-31783

SUMMARY OF INVENTION

Technical Problem

The exhaust treatment device is relatively larger than the alternator or the like. Therefore, when an attempt is made to obtain good maintainability of the alternator while the exhaust treatment device is disposed near the engine, it is difficult to secure a space for disposing the exhaust treatment device in an engine room inside the hood. In particular, for example, in a relatively small work machine, such as a small shovel, since a space of an engine room is limited, depending on an arrangement position of an exhaust treatment device, a space for an operation section provided in front of the engine room may be reduced, or it may be difficult to balance a weight of a machine body.

The present disclosure has been made in view of the problems as described above, and it is an object of the present disclosure to provide a work machine including an exhaust treatment device, which is capable of achieving excellent maintainability of devices, such as an alternator, arranged near an engine, and efficiently arranging the devices in an engine room.

Solution to Problem

According to an aspect of the present disclosure, a work machine includes an engine having an output shaft projecting to one side in a lateral direction of a machine body, a hydraulic pump disposed on the other side in the lateral direction of the engine, an exhaust treatment device disposed above the engine and treating exhaust gas discharged from the engine, and an alternator driven by rotational power of the output shaft. The alternator is disposed at a position behind the engine and below the exhaust treatment device.

The work machine may further include a compressor driven by the rotational power of the output shaft and disposed below the alternator.

In the work machine, at least a part of the compressor may be positioned behind the alternator in the machine body.

In the work machine, the engine may be installed in an engine room disposed in a rear portion of the machine body. The work machine may further include a shielding portion that covers the engine room from a rear side and has an opening portion that exposes the engine room to an outside and a cover body that covers the opening portion in an openable/closable manner. The alternator may be disposed at a position at which at least a portion of the alternator overlaps an opening range of the opening portion in a rear view of the machine body. The compressor may be disposed at a position at which at least a portion of the compressor overlaps the shielding portion in a rear view of the machine body.

In the work machine, the exhaust treatment device may include a cylindrical filter case into which exhaust gas discharged from the engine is introduced. The filter case may be disposed in a direction in which a longitudinal direction of the filter case is a front-rear direction of the machine body.

In the work machine, the alternator may be disposed in a state in which one end side of the alternator is supported in a rotatable manner on the engine, and the other end side of the alternator is fixed to and supported by a support bracket extending from a support member supporting the exhaust treatment device with respect to the engine toward the rear of the machine body in a position changeable manner to allow rotation of the alternator.

The work machine may further include a fan disposed on one side of the engine in the lateral direction, and a protection member detachable from the shielding portion and shielding a part of the opening portion. The protection member may be disposed such that at least a part of the protection member overlaps a space between the engine and the fan in the rear view of the machine body.

In the work machine, the shielding portion may include a shielding main body portion forming a lower portion of the shielding portion and projecting portions extending upward from both left and right ends of the shielding main body portion and forming the opening portion together with the shielding main body portion. The protection member may be disposed for one of the left and right projecting portions.

Advantageous Effects of Invention

According to the present disclosure, in a configuration including an exhaust treatment device, it is possible to obtain favorable maintainability of devices, such as an alternator disposed near an engine, and to efficiently dispose the devices in an engine room.

DESCRIPTION OF EMBODIMENTS

The present disclosure is provided to improve maintainability of devices included in an engine room and to effectively utilize a space in the engine room by contriving arrangement of the devices disposed near an engine, such as an alternator, in a configuration including an exhaust treatment device for treating exhaust gas of the engine. Hereinafter, an embodiment of the present disclosure will be described with reference to the accompanying drawings.

In the embodiment of the present disclosure, the description is to be made on an excavation work machine (shovel), which is a swivel work vehicle, as an example of a work machine according to the present disclosure. Note that, a work machine according to the present disclosure is not limited to the excavation work machine, and is widely applicable to other types of work machine, such as a bulldozer, a crane work machine, a compact truck loader, a skid steer loader, and a wheel loader.

Figure 1:
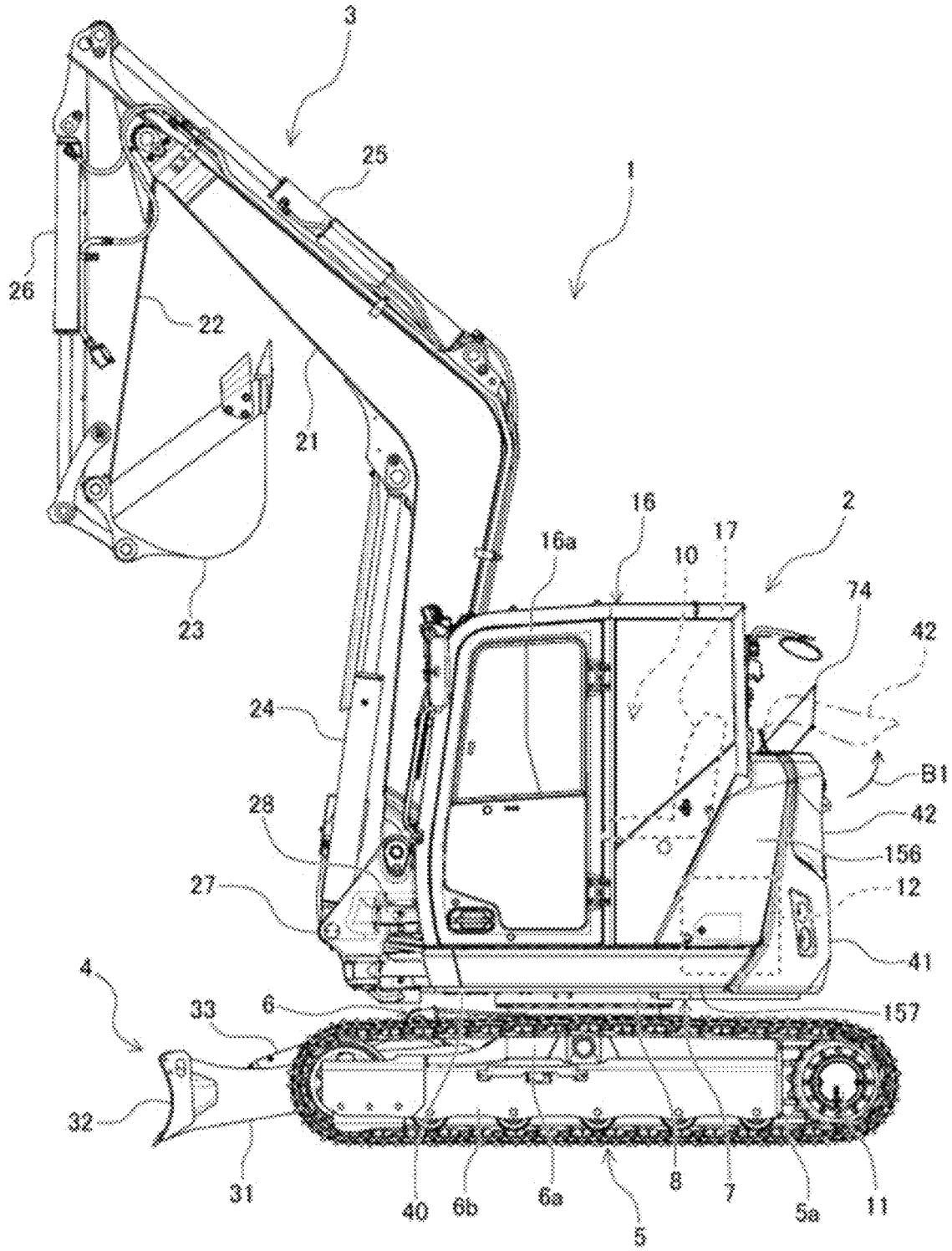
FIG. 1 is a left side view of an excavation work machine according to an embodiment of the present disclosure.
Figure 2:
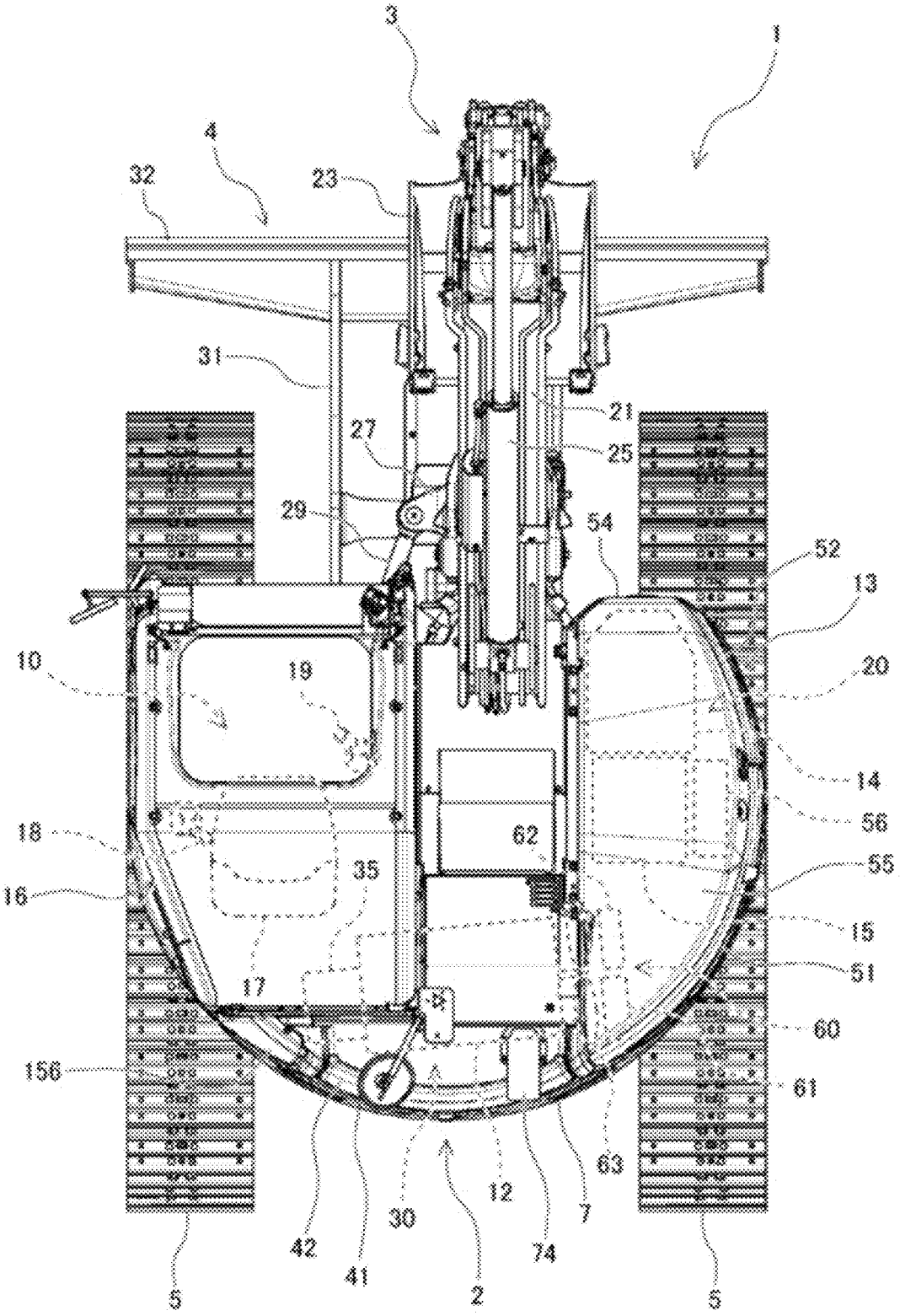
FIG. 2 is a plan view of the excavation work machine according to the embodiment of the present disclosure.
Figure 3:
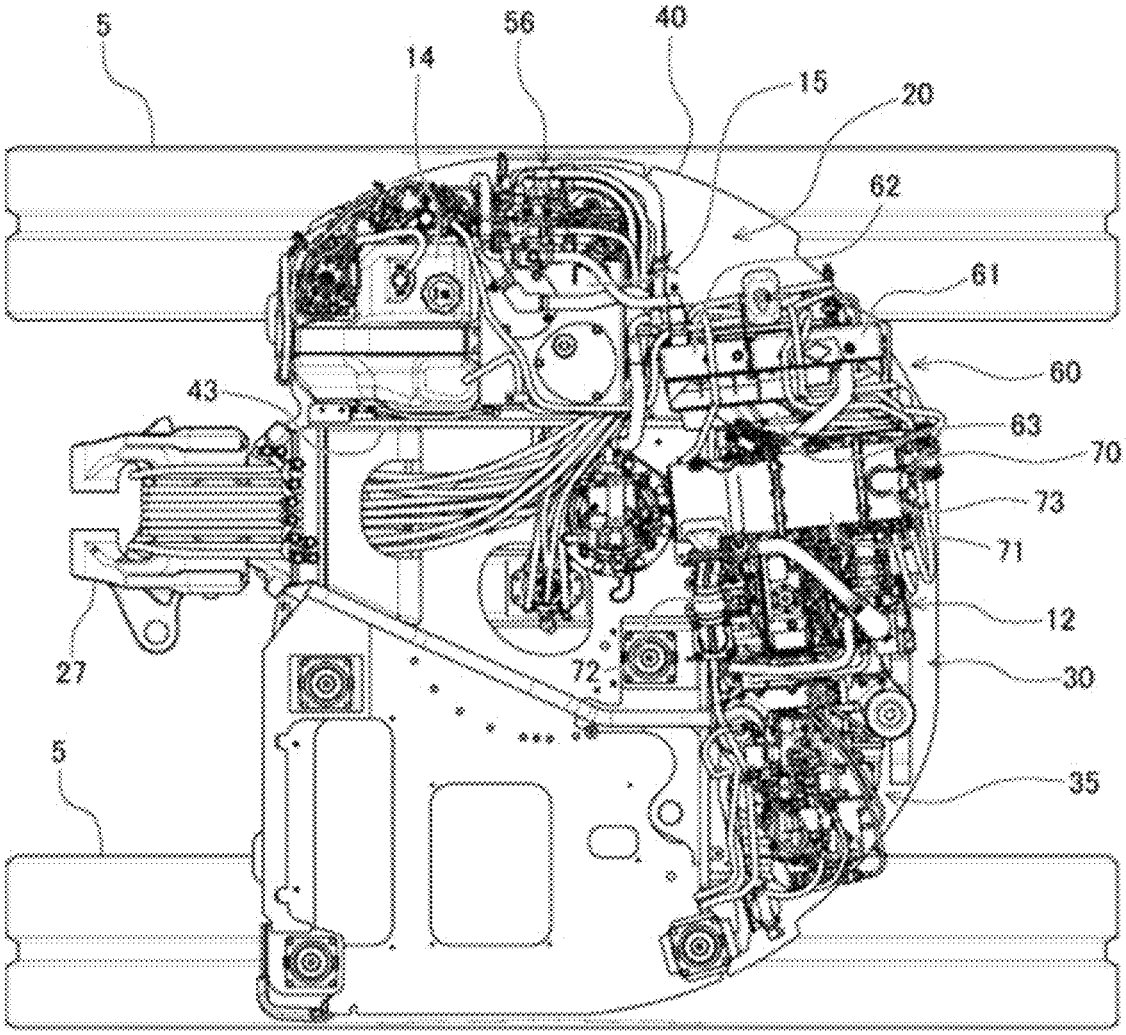
FIG. 3 is a plan view illustrating an arrangement configuration of devices on a base plate of the excavation work machine according to the embodiment of the present disclosure.

A description will be made on an overall configuration of an excavation work machine 1 according to the embodiment with reference to FIGS. 1 to 3. Note that, in the following description, a left side and a right side relative to a front (the left in FIG. 1) of the excavation work machine 1 are referred to as a left side and a right side of the excavation work machine 1, respectively. As illustrated in FIGS. 1 and 2, the excavation work machine 1 includes a traveling device 2 as a self-propelled traveling body, and an excavation device 3 and a soil removal device 4 which are work portions mounted on the traveling device 2.

The traveling device 2 serves as a main machine of the excavation work machine 1 and has a pair of crawler-type traveling sections 5 on the right and left, a machine body frame 6 serving as a base stand installed between the right and left traveling sections 5, and a swivel frame 7 installed on the machine body frame 6.

Each of the traveling sections 5 has a configuration in which a crawler is wound around a plurality of rotating bodies, such as sprockets and rollers, supported by the machine body frame 6. Each of the traveling sections 5 has, at a rear end thereof, a drive sprocket 5*a* as a drive wheel. The machine body frame 6 has a center frame section 6*a* positioned in a middle part between the right and left traveling sections 5 and side frame sections 6*b* disposed on both right and left sides of the center frame section 6*a*.

Each of the traveling sections 5 has a traveling hydraulic motor 11. The traveling hydraulic motor 11 is attached in a predetermined portion, such as the side frame section 6*b* of the machine body frame 6, in a corresponding one of the traveling sections 5 so as to rotationally drive the drive sprocket 5*a*. Each of the left and right traveling hydraulic motors 11 drives a corresponding one of the traveling sections 5 so that the traveling device 2 travels straightly back and forth or swivels and travels to the left and right.

The swivel frame 7 is coupled to the machine body frame 6 via a swivel support section 8 including a swivel bearing disposed on an upper side of the center frame section 6*a*, and can be swiveled in either left or right direction about a vertical axis.

The swivel frame 7 is swiveled by driving of a swivel motor (not illustrated) which is a hydraulic motor for swiveling.

An operation section 10 is provided on the swivel frame 7. Furthermore, a prime mover section including an engine 12 as a drive source is disposed on a rear portion on the swivel frame 7. On a right side of the operation section 10, a tank accommodation section 13 accommodating a fuel tank 14 and a hydraulic oil tank 15 is disposed (refer to FIG. 2).

The operation section 10 is used to drive and operate the traveling device 2, the excavation device 3, and the soil removal device 4, and is disposed in a cabin 16 installed on the swivel frame 7. The cabin 16 has a frame that forms an outline thereof and a plurality of window sections made of a transparent member, such as glass, and is configured as a whole in a substantially box shape. The cabin 16 has, in a left side surface portion, an openable door 16*a* that opens and closes an entrance for an operator to the operation section 10.

In the cabin 16, a driver's seat 17 is disposed on a driver's seat support base disposed on a floor portion. A traveling manipulation unit, such as a traveling lever, a work manipulation unit, such as a work manipulation lever for operating work sections, such as the excavation device 3 and the soil removal device 4, an operation panel unit having various manipulation units, such as switches, and the like are disposed near the driver's seat 17.

Regarding the work manipulation unit, a left side work manipulation lever 18 is disposed on a left side of the driver's seat 17, and a right work operation lever 19 is disposed on a right side of the driver's seat 17 (refer to FIG. 2). The excavation device 3 is operated by the right and left manipulation levers.

A base end portion of the excavation device 3 is mounted on a laterally-center portion of a front end of the swivel frame 7. The excavation device 3 has a boom 21 that constitutes a base end portion thereof, an arm 22 that is coupled to a tip end side of the boom 21, and a bucket 23 that is attached to a tip end portion of the arm 22. Furthermore, the excavation device 3 has a boom cylinder 24 that rotates the boom 21, an arm cylinder 25 that rotates the arm 22, and a bucket cylinder 26 that rotates the bucket 23.

The base end portion of the boom 21 is supported by a boom support bracket 27. The boom support bracket 27 is supported by a bracket attachment section 28 protruding from a central portion in the lateral direction of a front end of the swivel frame 7 via a swing shaft with a vertical direction as a rotation axis direction. The excavation device 3 is disposed to swing to the right and left about the swing shaft with respect to the swivel frame 7 by an expansion and contraction movement of a swing cylinder 29 disposed between the boom support bracket 27 and the swivel frame 7. The boom cylinder 24, the arm cylinder 25, and the bucket cylinder 26 that are included in the excavation device 3 and the swing cylinder 29 that swings the excavation device 3 are each a hydraulic cylinder actuated by pressure oil discharged by a hydraulic pump 35.

The soil removal device 4 is attached to a front side of the machine body frame 6. The soil removal device 4 has a support frame 31 that includes a pair of right and left arms, each of which extends in a front-rear direction between the right and left traveling sections 5, a blade 32 as a soil removal plate disposed on a tip end side of the support frame 31, and a blade cylinder 33 that lifts/lowers the blade 32 via the support frame 31. The blade cylinder 33 is a hydraulic cylinder operated by pressure oil discharged from the hydraulic pump 35.

The support frame 31 is attached to the machine body frame 6 so as to be lifted and lowered in a rotatable manner, by having a rear end portion of the right and left arms supported in a rotatable manner by a support bracket disposed in a front portion of the machine body frame 6 with the lateral direction as a rotation axis direction. The blade 32 is installed in a state of being supported by a front end portion of the support frame 31. The blade cylinder 33 is disposed in a state of being hung in the front-rear direction between the machine body frame 6 and a back side of the blade 32.

The excavation work machine 1 includes a lower traveling body, which is configured to include the machine body frame 6 and the traveling sections 5 supported on both the left and right sides of the machine body frame 6, and an upper swivel body mounted on the lower traveling body in a swiveling available manner. The upper swivel body includes the swivel frame 7, and the operation section 10, the engine 12, and the tank accommodation section 13 disposed on the swivel frame 7.

A counterweight 41 is disposed in a rear lower portion of the swivel frame 7. A hood 42 is disposed on an upper side of the counterweight 41 so as to be openable and closable. The hood 42 constitutes a cover portion that covers a rear side of the swivel frame 7.

In the excavation work machine 1 having the above-described configuration, an operator who is seated on the driver's seat 17 properly operates the traveling lever, the work manipulation lever, or the like, to perform a desired action or a desired work. Specifically, for example, when the traveling lever is operated, the traveling device 2 travels straight forward and backward or turns right and left by operating the right and left traveling sections 5. Furthermore, when the work operation lever is operated, the excavation work by the excavation device 3, or the soil removal work or ground leveling work by the soil removal device 4 is performed.

Hereinafter, various device configurations disposed on the swivel frame 7 will be described with reference to FIGS. 2 to 14. Note that, in FIG. 4, the hood 42 is omitted.

On the base plate 40 included in the swivel frame 7, the tank accommodation section 13 is disposed in a portion of a right region on the base plate 40. The base plate 40 is a plate-like frame member horizontally disposed, and forms a bottom surface portion of the swivel frame 7.

The tank accommodation section 13 is configured such that the fuel tank 14, the hydraulic oil tank 15, and the like are accommodated in a tank chamber 20 sectioned on the base plate 40. The tank chamber 20 is sectioned from a portion on a center side in the lateral direction on the base plate 40 by a bulkhead portion including a portion of a vertical plate 43 disposed on the base plate 40.

The rear side of the tank chamber 20 is spatially continuous with an engine room 30 that accommodates the engine 12 disposed at a rear portion on the base plate 40. An intermediate portion in the lateral direction on a rear side of the engine room 30 is covered with a counterweight 41 and the hood 42. The cabin 16 is disposed on a left side of the tank chamber 20 on the swivel frame 7.

In the tank accommodation section 13, a portion on the right side of the vertical plate 43 on the base plate 40 is covered with a plurality of exterior covers which are covering members so that the tank chamber 20 serving as an accommodation space is formed. Each of the plurality of exterior covers has a shape and a size corresponding to a shape of the swivel frame 7 and the arrangement of the configurations on the swivel frame 7.

The tank accommodation section 13 has, as the exterior covers, a right rear cover 51 that covers a right lateral rear portion of the tank chamber 20, a right front cover 52 that covers a right lateral front portion of the tank chamber 20, a lower right cover 53 that covers a right lower portion of the tank chamber 20, and a front cover 54 that covers a front portion of the tank chamber 20. These covers are, for example, metal covers. The tank accommodation section 13 further has an upper surface cover 55 that is a cover member that covers an upper side of the tank chamber 20 as an exterior cover. The upper surface cover 55 is a resin cover, for example, and is disposed so as to be openable and closable.

In the tank chamber 20, the fuel tank 14 is disposed on a front portion, and the hydraulic oil tank 15 is disposed on a rear side of the fuel tank 14. The fuel tank 14 is a fuel oil tank that stores fuel oil to be supplied to the engine 12. The hydraulic oil tank 15 stores hydraulic oil for actuating various hydraulic actuators included in the excavation work machine 1. The various hydraulic actuators that are actuated by receiving supply of pressure oil from the hydraulic oil include hydraulic cylinders, such as the boom cylinder 24, the arm cylinder 25, the bucket cylinder 26, and the swing cylinder 29, as well as the traveling hydraulic motor 11 and the swivel motor.

The hydraulic oil tank 15 is disposed behind the fuel tank 14, and is located at a substantially central portion in the front-rear direction in the tank chamber 20. The fuel tank 14 and the hydraulic oil tank 15 are mounted on and supported by the base plate 40. The fuel tank 14 and the hydraulic oil tank 15 are disposed adjacent to each other in the front-rear direction. In the tank chamber 20, a control valve 56 is disposed adjacent to the hydraulic oil tank 15 on a right side of the hydraulic oil tank 15. The control valve 56 is a device for controlling a flow of the pressure oil supplied from the hydraulic oil tank 15 to the plurality of hydraulic actuators by driving the hydraulic pump 35. By controlling supply of the pressure oil to the individual hydraulic actuators, an operation of the excavation device 3, a traveling operation of the traveling device 2, and the like are performed.

On the base plate 40, a heat exchanger 60 and the engine 12 are disposed in the engine room 30 connected to the rear side of the tank chamber 20. The heat exchanger 60 is disposed on a right side, which is one side of the engine 12 in the lateral direction. The heat exchanger 60 is a device configuration having a heat exchange function for cooling the engine 12, and includes a radiator 61, an oil cooler 62, and a fan 63.

The radiator 61 is a device for cooling cooling water of the engine 12. The oil cooler 62 is a device for cooling oil (hydraulic oil) pumped by the hydraulic pump 35. Each of the radiator 61 and the oil cooler 62 has a substantially cuboid outer shape so as to have a substantially rectangular shape in a plan view. In the plan view, the radiator 61 and the oil cooler 62 are arranged side by side in the front-rear direction, with the radiator 61 on the rear side and the oil cooler 62 on the front side, in a direction in which a longitudinal direction is perpendicular or substantially perpendicular to an axial direction of an output shaft 65 of the engine 12.

The fan 63 is a cooling fan that rotates in conjunction with the engine 12, and sends air toward the engine 12. The fan 63 is disposed between a right side surface portion of the engine 12 and the radiator 61 and the oil cooler 62. Outside air for cooling is taken into the engine room 30 through a plurality of opening portions 51*a* (refer to FIG. 4) formed in the right rear cover 51 by the fan 63 so that the radiator 61, the oil cooler 62, and the like are cooled.

The engine 12 is installed in a rear portion of the base plate 40 with the axial direction of the output shaft 65 corresponding to substantially the lateral direction or corresponding to the lateral direction. That is, the engine 12 is transversely disposed and mounted such that the axial direction of the output shaft 65 substantially coincides with or coincides with the lateral direction of the machine body.

In this embodiment, the engine 12 is transversely disposed such that the axial direction of the output shaft 65 is inclined by approximately 5 degrees to 8 degrees in a counterclockwise direction from the lateral direction in the plan view. The engine 12 is disposed in a state of being supported in a vibration-damping manner at a plurality of positions via a vibration-damping member 66 and the like with respect to a predetermined engine support portion disposed on the base plate 40.

The output shaft 65 of the engine 12 protrudes to the right side, which is one side in the lateral direction of the machine body. The output shaft 65 is located at a lower portion of a right side surface of the engine 12 substantially at the center in the front-rear direction (refer to FIG. 5). The engine 12 is a diesel engine that receives fuel supplied from the fuel tank 14.

The hydraulic pump 35 is disposed on a left side, which is the other side of the engine 12 in the lateral direction. That is, the hydraulic pump 35 is disposed on a side opposite to the protruding side of the output shaft 65 in the axial direction of the output shaft 65 of the engine 12. A rotation shaft of the hydraulic pump 35 is connected to a drive shaft of the engine 12 via a coupling. The hydraulic pump 35 is driven by the rotation of the drive shaft of the engine 12, and feeds the hydraulic oil in the hydraulic oil tank 15 to the various hydraulic actuators via the control valve 56.

An exhaust gas purification device 70 for purifying exhaust gas discharged from the engine 12 is disposed for the engine 12. The exhaust gas purification device 70 is an example of an exhaust treatment device that is disposed above the engine 12 and treats exhaust gas discharged from the engine 12. Combustion gas generated in a combustion chamber of the engine 12 is discharged out of the engine room 30 through the exhaust gas purification device 70.

The exhaust gas purification device 70 includes a DPF case 71, which is a diesel particulate filter case, as a cylindrical filter case into which the exhaust gas discharged from the engine 12 is introduced. The exhaust gas purification device 70 introduces exhaust gas discharged from the engine 12 into the DPF case 71 and removes particulate matter, such as soot contained in the exhaust gas, thereby purifying the exhaust gas.

The DPF case 71 has a diesel oxidation catalyst and a soot filter in the case. The diesel oxidation catalyst is an oxidation catalyst, such as platinum, that generates nitrogen dioxide (NO2). The soot filter has a honeycomb structure that continuously oxidizes and removes trapped particulate matter at a relatively low temperature. In the DPF case 71, the diesel oxidation catalyst and the soot filter are arranged in series with respect to a flow of the exhaust gas, with the diesel oxidation catalyst on an upstream side and the soot filter on a downstream side. The diesel oxidation catalyst and the soot filter remove the particulate matter mainly including black smoke in the exhaust gas of the engine 12 passing through the DPF case 71, and reduce carbon monoxide (CO) and hydrocarbon (HC) in the exhaust gas.

The DPF case 71 is configured as a substantially cylindrical case. In the DPF case 71, a longitudinal direction (cylinder axis direction) of a substantially cylindrical outer shape corresponds to a direction of the flow of the exhaust gas in the case. The DPF case 71 is disposed in a direction in which the longitudinal direction thereof is the front-rear direction or a substantially front-rear direction of the machine body. In this embodiment, the DPF case 71 is disposed such that the longitudinal direction thereof is orthogonal to the axial direction of the output shaft 65 of the engine 12 in the plan view. A mounting plate 71*c* that is removed when a filter inside the DPF case 71 is replaced is disposed on an end surface portion on a rear side of the DPF case 71. The filter in the DPF case 71 can be removed by removing the mounting plate 71*c*.

The DPF case 71 is disposed above the engine 12. The DPF case 71 has substantially the same size as the engine 12 in the front-rear direction, and is disposed such that the entire DPF case 71 is substantially positioned above the engine 12. The DPF case 71 is disposed above a right portion of the engine 12 in the lateral direction.

The DPF case 71 is fixed to and supported by the engine 12 at two front and rear positions by means of a front support stay 75 and a rear support stay 76, respectively. The front support stay 75 is fixed to a front portion of an upper right portion of the engine 12, protrudes upward from the engine 12, supports a front portion of the DPF case 71 from below, and holds the front portion of the DPF case 71 together with a holding belt 77 extending along an outer peripheral surface of the DPF case 71. The rear support stay 76 is fixed to a rear portion of the upper right portion of the engine 12, protrudes upward from the engine 12, and is fixed to a lower portion of a flange portion 71*a* disposed on a rear portion of the DPF case 71 by bolts or the like, thereby supporting the rear portion of the DPF case 71 from below.

One end side (downstream side) of an exhaust pipe 72 that discharges exhaust gas from the engine 12 is communicatively coupled to the DPF case 71. The DPF case 71 is coupled to one end of the exhaust pipe 72 on a left side of a front portion thereof. The other end side (upstream side) of the exhaust pipe 72 is communicatively coupled to an exhaust gas outlet side of a turbocharger (not illustrated) disposed on an exhaust manifold constituting an exhaust gas outlet portion in the engine 12. Exhaust gas in the engine 12 is introduced into the DPF case 71 through the exhaust pipe 72.

An outlet pipe 73 for discharging the exhaust gas in the DPF case 71 is disposed on a rear portion of the DPF case 71. The outlet pipe 73 protrudes upward from an upper side of the DPF case 71. The outlet pipe 73 penetrates an upper surface portion 42*a* of the hood 42 and protrudes upward from the upper surface portion 42*a*. A tail pipe 74 constituting a discharge pipe portion of the exhaust gas purification device 70 together with the outlet pipe 73 is attached to the upper surface portion 42*a* of the hood 42.

The excavation work machine 1 includes, as devices disposed near the engine 12, an alternator 81 driven by rotational power of the output shaft 65 of the engine 12 and a compressor 82 driven by the rotational power of the output shaft 65. Both the alternator 81 and the compressor 82 are disposed on a right side surface portion which is a side surface portion on the output shaft 65 side of the engine 12.

The alternator 81 is driven by the power of the engine 12 to generate and output electric power. The alternator 81 is used as a power source or a generator for storing electricity in a battery.

The compressor 82 is used for an air conditioning unit included in the excavation work machine 1, and is driven by the power of the engine 12 to compress air conditioning gas (refrigerant). The air for air-conditioning generated by the air conditioning unit is supplied in a compression manner through a duct (not illustrated), and is blown out from a plurality of air outlets provided in the cabin 16. The air conditioning unit is disposed below the driver's seat 17.

The alternator 81 is driven by the rotational power of the output shaft 65 of the engine 12 transmitted by a first belt transmission mechanism 91. The first belt transmission mechanism 91 includes an output pulley 93 attached to the output shaft 65, an alternator input pulley 94 disposed on the alternator 81, and a first belt 95 wound around these pulleys.

The output pulley 93 is fixed to the output shaft 65, and rotates integrally with the output shaft 65 with its rotation shaft direction aligned with the axial direction of the output shaft 65. The output pulley 93 is a so-called double pulley and has two outer circumferential grooves adjacent to each other in the rotation shaft direction. The first belt 95 is engaged with the groove on the right side (front side in FIG. 5) of the output pulley 93. The alternator input pulley 94 is disposed on a right side of the alternator 81, and is fixed to the rotation shaft 81*a* of the alternator 81 having an axis direction parallel to the output shaft 65. A rotation shaft direction of the alternator input pulley 94 is aligned with an axial direction of the rotation shaft 81*a* of the alternator 81, and the alternator input pulley 94 rotates integrally with the rotation shaft 81*a*.

A fan pulley 97 for rotationally driving the fan 63 is disposed over the output pulley 93. The fan pulley 97 is disposed on a right side surface portion of the engine 12 so as to be rotatable with respect to a shaft support portion disposed over the output shaft 65 with an axial direction parallel to the output shaft 65. The fan pulley 97 constitutes the first belt transmission mechanism 91 together with the output pulley 93 and the alternator input pulley 94 around which the first belt 95 is wound, and receives the rotational power of the output shaft 65. The fan 63 is disposed so as to rotate integrally with the fan pulley 97, and rotates in conjunction with the rotation of the output shaft 65.

The compressor 82 is driven when receiving transmission of the rotational power of the output shaft 65 of the engine 12 transmitted by a second belt transmission mechanism 92. The second belt transmission mechanism 92 includes the output pulley 93 attached to the output shaft 65, a compressor input pulley 98 disposed on the compressor 82, and a second belt 99 wound around these pulleys.

The second belt 99 is engaged with the groove on the left side (depth side in FIG. 5) of the output pulley 93. That is, in the axial direction of the output shaft 65, the compressor input pulley 98 is positioned on the left side with respect to the alternator input pulley 94, and the second belt 99 is disposed at a position shifted to the left with respect to the first belt 95. The compressor input pulley 98 is disposed on a right side of the compressor 82, and is fixed to a rotation shaft 82*a* of the compressor 82 with an axis direction in parallel to the output shaft 65. A rotation shaft direction of the compressor input pulley 98 is aligned with an axial direction of the rotation shaft 82*a* of the compressor 82, and the compressor input pulley 98 rotates integrally with the rotation shaft 82*a*.

As described above, in the configuration in which the engine 12, the hydraulic pump 35, the exhaust gas purification device 70, the alternator 81, and the compressor 82 are included in the engine room 30, the alternator 81 is disposed at a position behind the engine 12 and below the exhaust gas purification device 70.

Figure 5:
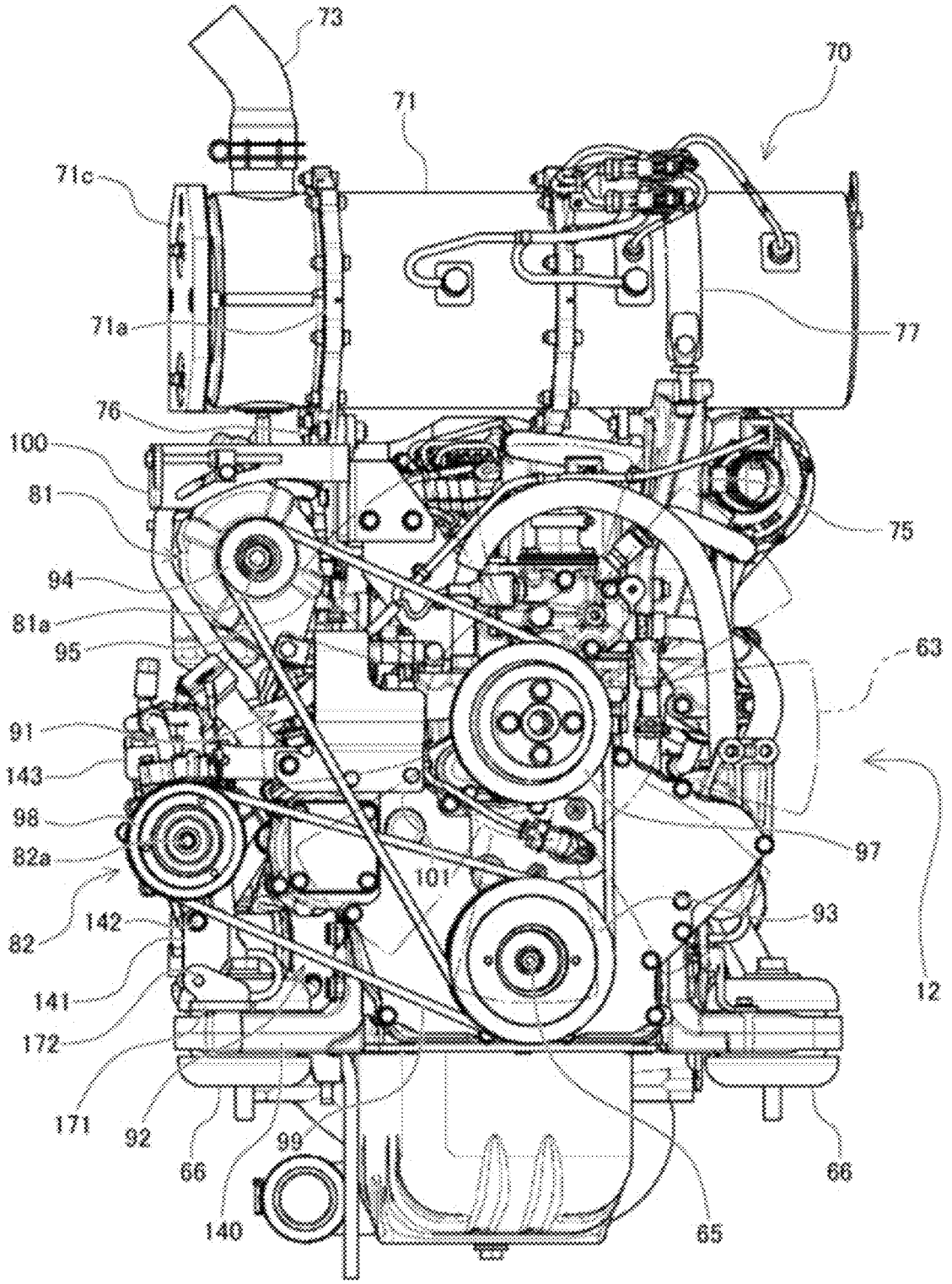
FIG. 5 is a right side view of an engine according to the embodiment of the present disclosure.

As illustrated in FIG. 5, the alternator 81 is disposed on a right side of the engine 12 and on a rear side of an upper portion of the engine 12. The alternator 81 is disposed at a position rearward of the output shaft 65 located substantially at the center in the front-rear direction. The alternator 81 is entirely located rearward of the output pulley 93 in the front-rear direction. Furthermore, the alternator 81 is positioned above the fan pulley 97 in the vertical direction, and is disposed at a position obliquely rearward and upward with respect to the fan pulley 97.

Moreover, the alternator 81 is disposed below a rear end portion of the DPF case 71 in the front-rear direction. Specifically, the alternator 81 is disposed so as to be entirely or substantially entirely positioned below a portion of the DPF case 71 on the rear side of the flange portion 71*a* on the upper side of which the outlet pipe 73 is disposed.

As illustrated in FIG. 5, the compressor 82 is disposed below the alternator 81. The alternator 81 and the compressor 82 have substantially cylindrical outer shapes whose relative sizes with respect to the engine 12 are substantially the same as each other. In detail, the alternator 81 is slightly larger than the compressor 82. A height position of an upper end of the compressor 82 is positioned lower than a height position of a lower end of the alternator 81 in the vertical direction.

Furthermore, at least a portion of the compressor 82 is positioned behind the alternator 81 in the machine body. That is, the compressor 82 located below the alternator 81 is disposed on the rear side of the alternator 81 in the front-rear direction. Therefore, the rotation shaft 82*a* of the compressor 82 is positioned rearward of the rotation shaft 81*a* of the alternator 81 in the front-rear direction.

In this embodiment, the compressor 82 is disposed such that a substantially front half of the compressor 82 overlaps with a substantially rear half of the alternator 81 in the front-rear direction (refer to FIG. 5). A rear portion of the compressor 82 disposed as described above is positioned rearward of the DPF case 71 in the front-rear direction.

Figure 6:
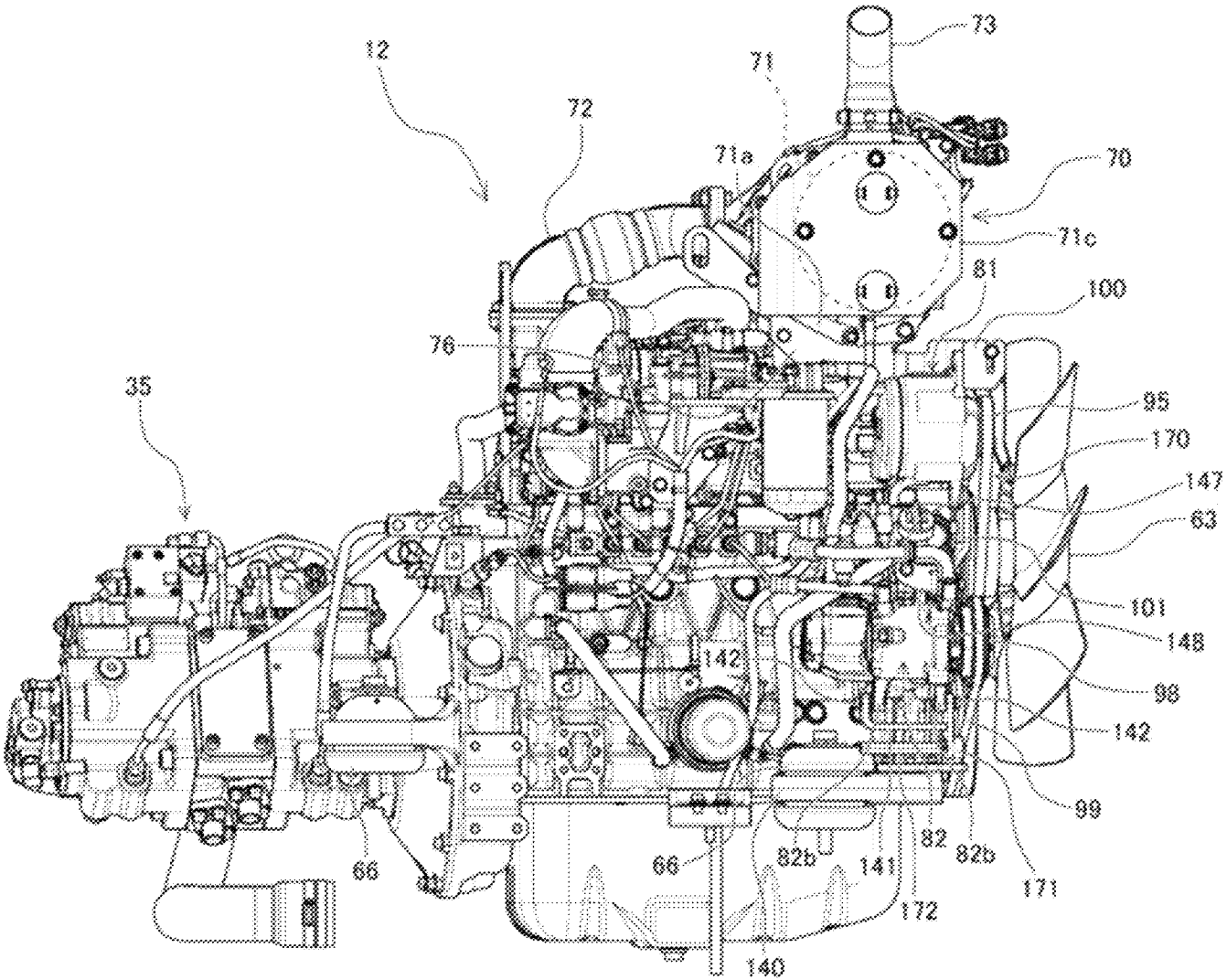
FIG. 6 is a rear view of the engine according to the embodiment of the present disclosure.

Furthermore, the alternator 81 and the compressor 82 are disposed so as to substantially entirely overlap with each other in the lateral direction (refer to FIG. 6). Therefore, the compressor 82 is disposed such that substantially the front half of the compressor 82 overlaps with a rear portion of the alternator 81 in the plan view.

The alternator 81 and the compressor 82, which are disposed so as to entirely overlap each other in the lateral direction, are disposed so as to entirely or substantially entirely overlap the DPF case 71 in the lateral direction except for a right end portion. That is, the alternator 81 and the compressor 82 are positioned entirely or substantially entirely below the DPF case 71 in the lateral direction. Therefore, in the rear view, the DPF case 71, the alternator 81, and the compressor 82 are vertically arranged along the vertical direction (refer to FIG. 6). In this embodiment, the DPF case 71, the alternator 81, and the compressor 82 are arranged at substantially equal intervals in the vertical direction.

Figure 7:
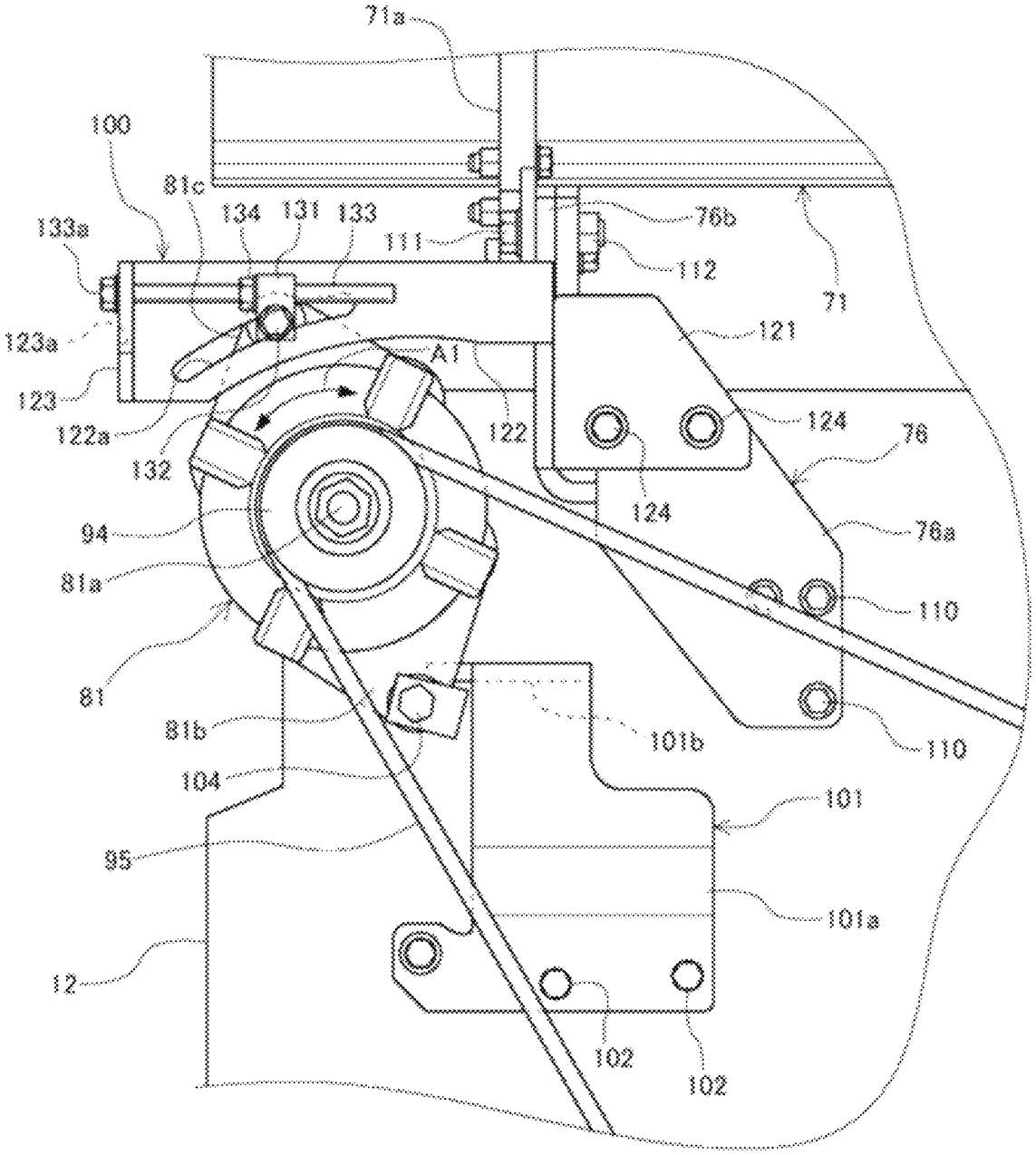
FIG. 7 is a right side view of a support configuration of an alternator according to the embodiment of the present disclosure.
Figure 8:
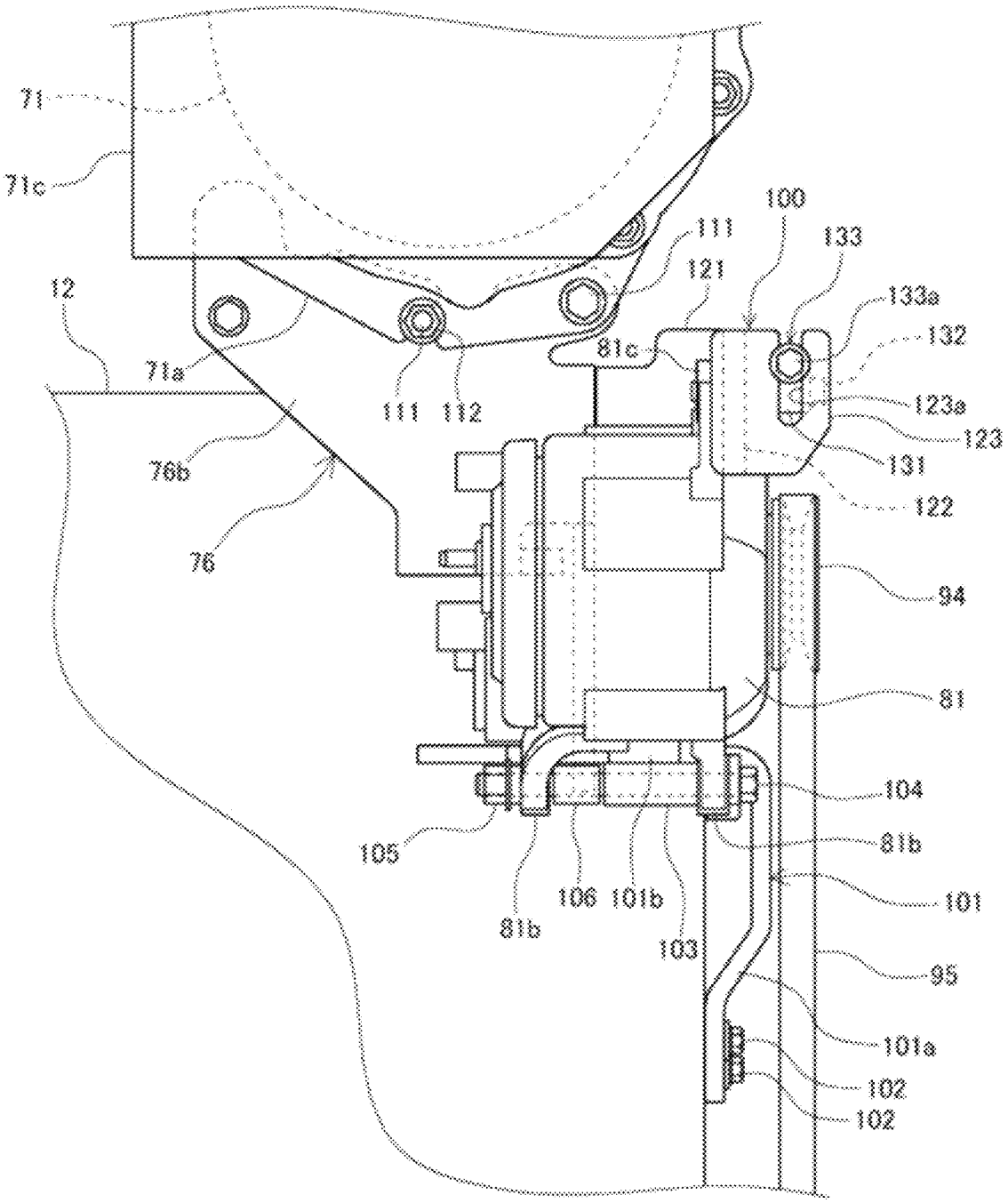
FIG. 8 is a rear view of a support configuration of an alternator according to the embodiment of the present disclosure.
Figure 9:
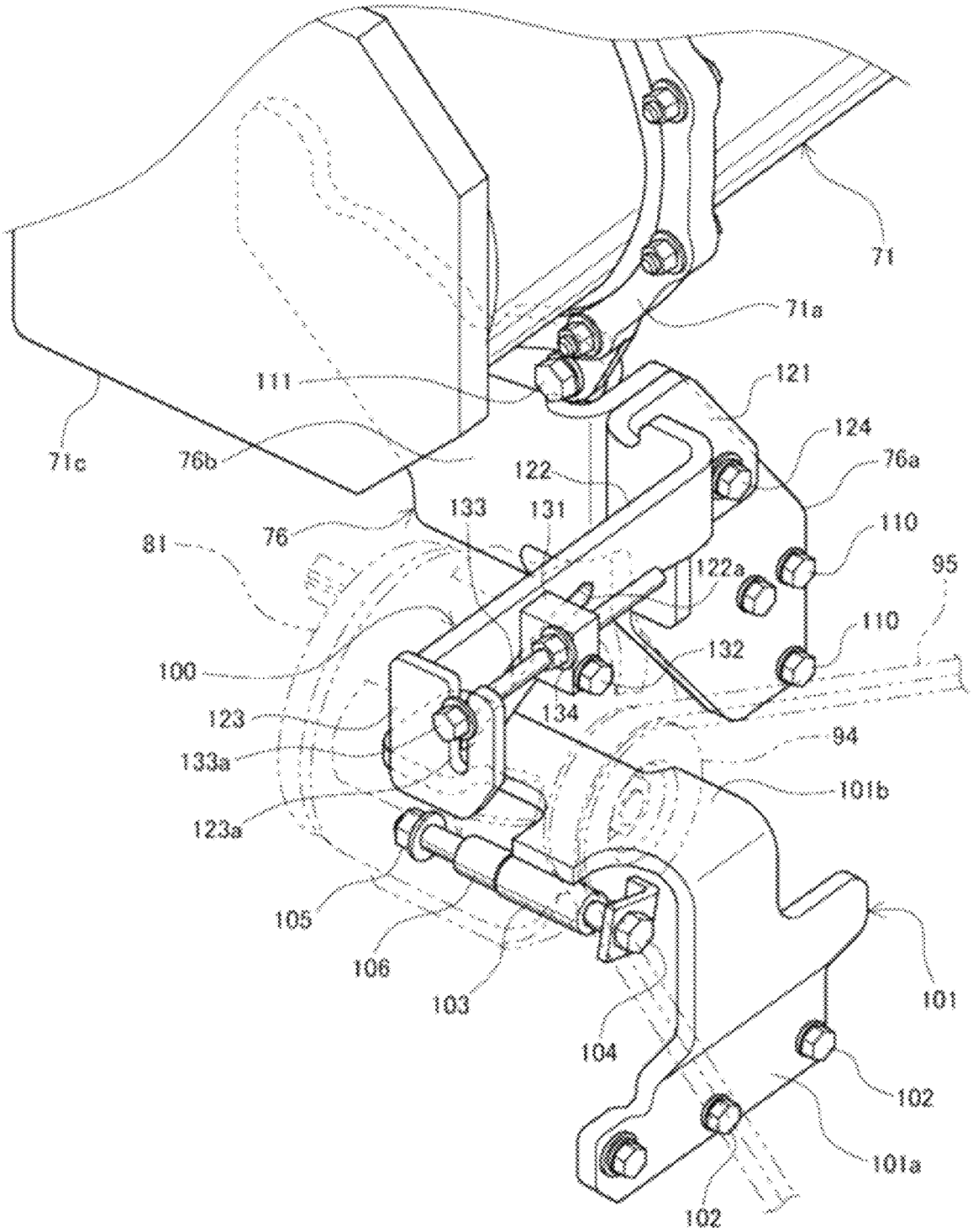
FIG. 9 is a perspective view of the support configuration of the alternator viewed from a right rear side according to the embodiment of the present disclosure.

A support structure of the alternator 81 will be described with reference to FIGS. 7 to 9. The alternator 81 is disposed in a state in which a lower end side, which is one end side, is supported in a rotatable manner with respect to the engine 12, and an upper end side, which is the other end side, is fixed and supported in a position changeable manner with respect to an upper support bracket 100, which is a support bracket disposed near the engine 12, so as to allow rotation of the alternator 81. That is, the lower side of the alternator 81 is supported in a rotatable manner by the engine 12 as a rotation support portion, and the upper side of the alternator 81 is movably supported by the engine 12 as a movable support portion.

The lower rotation support portion of the alternator 81 is supported by a lower support bracket 101, which is attached to the right side surface portion of the engine 12, so as to be rotatable about a rotation axis direction that coincides with (is parallel to) the axial direction of the rotation shaft 81*a*.

The lower support bracket 101 includes a fixing surface portion 101*a* extending along the right side surface portion of the engine 12, and a horizontal support surface portion 101*b* bent leftward at a right angle from an upper end portion of the fixing surface portion 101*a*.

The lower support bracket 101 fixes the fixing surface portion 101*a* to the right side surface portion of the engine 12 at a plurality of positions by fixing bolts 102. The lower support bracket 101 has a support cylindrical portion 103, on a rear side of the support surface portion 101*b*, which is a cylindrical portion whose both ends are opened with a direction coinciding with the axial direction of the rotation shaft 81*a* as a central axis direction. The support cylindrical portion 103 is fixed to the support surface portion 101*b* by welding or the like.

Meanwhile, the alternator 81 has two lower support projecting pieces 81*b* opposed to each other in the axial direction of the rotation shaft 81*a* on a lower end side of the housing forming the exterior thereof. The two lower support projecting pieces 81*b* are disposed on opposite sides in the axial direction of the rotation shaft 81*a* of the alternator 81 at an interval in the axial direction of the rotation shaft 81*a* on a lower side of a cylindrical main body portion of the housing of the alternator 81.

In the alternator 81, the support cylindrical portion 103 is positioned between the left and right lower support projecting pieces 81*b*, and a lower support bolt 104 penetrating the left and right lower support projecting pieces 81*b* and the support cylindrical portion 103 is supported in a rotatable manner as a support shaft. The lower support bolt 104 is inserted from a side near the right lower support projecting piece 81*b*, and a distal end portion thereof is projected leftward from the left lower support projecting piece 81*b* and is screwed into a nut 105, thereby fixing the alternator 81. A cylindrical collar 106 through which the lower support bolt 104 penetrates is interposed between the support cylindrical portion 103 and the left lower support projecting piece 81*b*.

The alternator 81 is supported by an upper movable support portion so as to be movable with respect to the upper support bracket 100. The upper support bracket 100 extends toward the rear of the machine body from the rear support stay 76, which is a support member that supports the DPF case 71 of the exhaust gas purification device 70 with respect to the engine 12.

The rear support stay 76 includes a fixing surface portion 76*a* extending along the right side surface portion of the engine 12 and a support surface portion 76*b* which is bent leftward at a right angle from a rear side of an upper portion of the fixing surface portion 76*a* and whose plate thickness direction is substantially the front-rear direction. A lower portion of the fixing surface portion 76*a* is fixed to the right side surface portion of the engine 12 at a plurality of locations by fixing bolts 110, and an upper portion of the fixing surface portion 76*a* extends above the engine 12. The support surface portion 76*b* serves as a portion to which the flange portion 71*a* of the DPF case 71 is fixed by inserting fixing tool, such as bolts 111. The bolts 111 penetrate the support surface portion 76*b* and the flange portion 71*a* and are screwed into nuts 112.

The upper support bracket 100 is fixed to the fixing surface portion 76*a* of the rear support stay 76 and extends rearward. The upper support bracket 100 includes a fixing surface portion 121 that is a portion fixed to the rear support stay 76, an arm portion 122 extending rearward from the fixing surface portion 121, and a locking surface portion 123 extending rightward from a rear end portion of the arm portion 122.

The upper support bracket 100 is fixed to the rear support stay 76 at a plurality of positions by fixing bolts 124 in a state in which the fixing surface portion 121 is superimposed on a right side of an upper portion of the fixing surface portion 76*a* of the rear support stay 76. The arm portion 122 is a plate-like portion whose plate thickness direction is substantially the lateral direction, and extends horizontally substantially in the front-rear direction. The locking surface portion 123 is a plate-like portion that forms a substantially right angle with the arm portion 122 in a plan view.

Meanwhile, the alternator 81 has an upper support projecting piece 81*c* on an upper end side of the housing. In the alternator, when viewed in the axial direction of the rotation shaft 81*a*, the upper support projecting piece 81*c* is disposed on a position opposite to the lower support projecting piece 81*b* with respect to the rotation shaft 81*a* as a center (i.e., on a substantially point-symmetrical position). The upper support projecting piece 81*c* is disposed on substantially the same position as the right lower support projecting piece 81*b* in the axial direction of the rotation shaft 81*a*.

The alternator 81 is supported by an upper support bolt 132 as a support shaft which penetrates a substantially cuboid guide block 131 disposed on a right side of the arm portion 122 and the arm portion 122 and is screwed into the upper support projecting piece 81*c*. In the arm portion 122, a guide hole 122*a* extending in an arc shape as viewed in the axial direction of the rotation shaft 81*a* is formed as a hole portion through which the upper support bolt 132 penetrates. The guide hole 122*a* has a shape along an arc centered on an axial center position of the lower support bolt 104, which is a center of rotation of the rotation support portion of the alternator 81, and allows the upper support bolt 132 to move with respect to the upper support bracket 100 as the alternator 81 rotates.

The guide block 131 has a lower portion through which the upper support bolt 132 penetrates and an upper portion through which the guide bolt 133 penetrates. The guide bolt 133 is provided along a direction orthogonal to the axial direction of the upper support bolt 132 in the plan view, penetrates the locking surface portion 123 by a recessed portion 123*a* which is formed in the locking surface portion 123 and whose upper side is opened, and locks a head portion 133*a* to a rear side of the locking surface portion 123. A positioning nut 134 is screwed onto the guide bolt 133 on a rear side of the guide block 131.

According to the support configuration of the alternator 81 having the above-described configuration, by loosening the fastening of the rotation support portion by the lower support bolt 104, the alternator 81 becomes rotatable about the lower support bolt 104 serving as a shaft. In this state, the guide block 131 on the guide bolt 133 is moved by operating the guide bolt 133 in the movable support portion so that a position of the alternator 81 in the rotational direction (refer to the arrow A1 in FIG. 7) around the lower support bolt 104 is adjusted.

As the position of the guide block 131 on the guide bolt 133 is adjusted, the upper support bolt 132 moves along the arc shape of the guide hole 122*a*, and the guide bolt 133 moves up and down along the recessed portion 123*a* of the locking surface portion 123. Tension of the first belt 95 is adjusted by adjusting the rotational position of the alternator 81. Note that an adjustable angular range of the rotation of the alternator 81 is, for example, approximately 20 degrees to 30 degrees.

In order to adjust the tension of the second belt 99, similarly to the alternator 81, a lower side of the compressor 82 is supported in a rotatable manner as a rotation support portion with respect to the engine 12, and an upper side of the compressor 82 is movably supported as a movable support portion.

Figure 10:
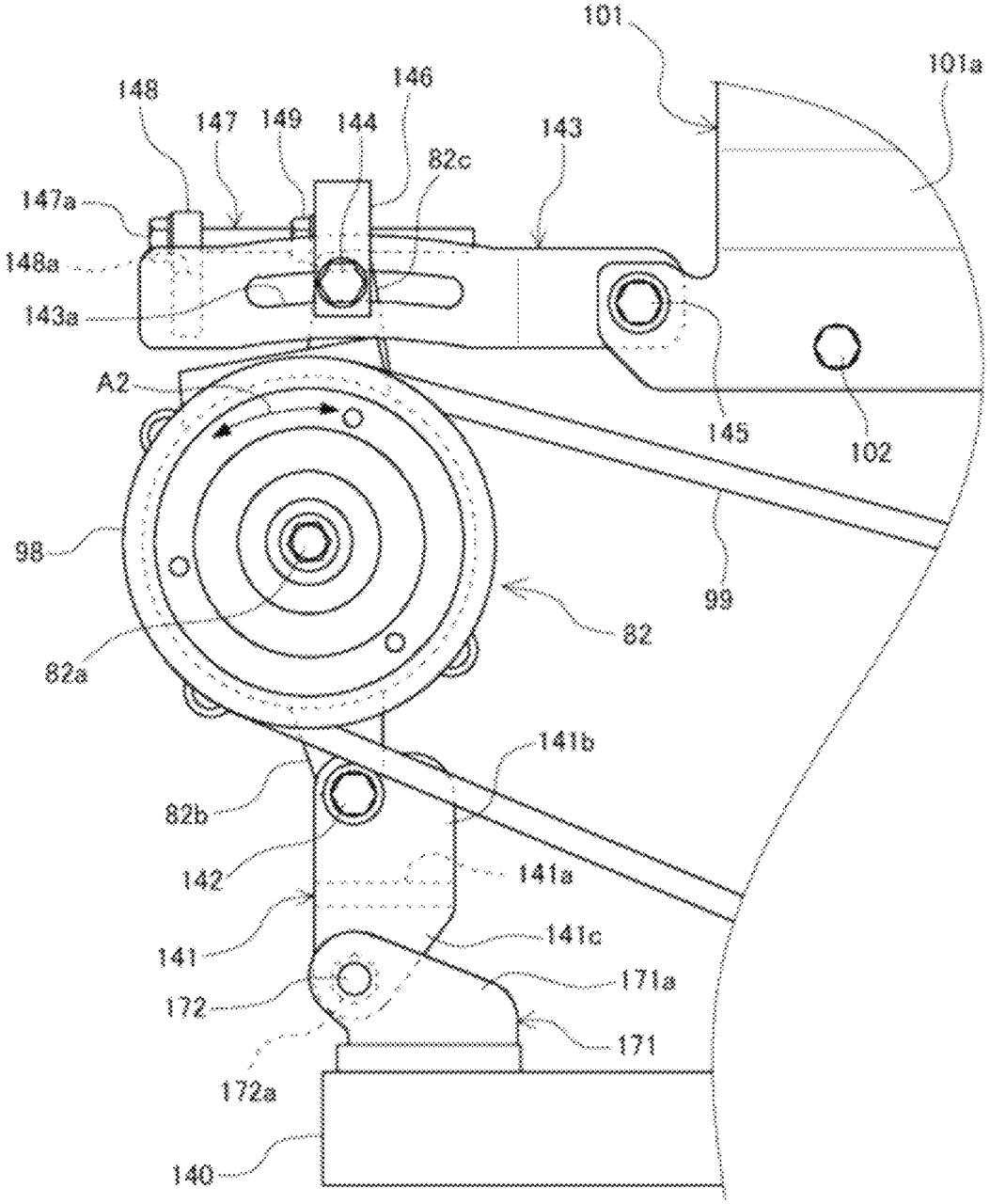
FIG. 10 is a right side view of a support configuration of a compressor according to the embodiment of the present disclosure.

The compressor 82 has two lower support projecting pieces 82*b* projecting from the lower side of the housing forming an exterior of the compressor 82 (refer to FIGS. 6 and 10). In the compressor 82, the lower support projecting pieces 82*b* are fastened and fixed by bolts 142 to respective side surface portions 141*a* of the lower support bracket 141 formed in a substantially "U" shape in a rear view by the lower surface portion 141*a* and right and left side surface portions 141*b*. The lower support bracket 141 has a support surface portion 141*c* formed by extending the right side surface portion 141*b* downward, and is supported in a rotatable manner by a support plate portion 171*a* of a support stay 171 disposed on the lower side of the lower support bracket 141 with the lower support bolt 172 as a support shaft. The axial direction of the center shaft of the lower support bolt 172, which serves as the rotational axis of the lower support bracket 141, coincides with (is parallel to) the axial direction of the rotation shaft 82*a*.

The lower support bolt 172 penetrates the support surface portion 141*c* from the left side and is screwed into the support plate portion 171*a*, and fixes the lower support bracket 141 to the support stay 171. In the lower support bolt 172, a portion on the left side from the support surface portion 141*c* is extended as a hexagonal columnar manipulation unit 172*a* having a hexagonal cross-sectional shape, and an end portion on the right side is screwed to the support plate portion 171*a* as a screw portion. The support stay 171 is fixedly provided on a substantially "L"-shaped mounting bracket 140 which is a predetermined support member disposed on a lower portion of the rear side of the engine 12 (refer to FIG. 5). Note that the attachment bracket 140 is a member to which the vibration-damping member 66 on the right rear side is attached.

On the other hand, the upper movable support portion of the compressor 82 has an upper support projecting piece 82*c* projecting upward from the housing (refer to FIG. 10). The compressor 82 is supported by an upper support bracket 143, which is fixed to a lower support bracket 101 supporting the lower side of the alternator 81 and extends rearward, by an upper support bolt 144 penetrating the upper support bracket 143. The upper support bracket 143 is fixed to the lower support bracket 101 by a fixing bolt 145 in a state in which a front end portion thereof is overlapped on the left side with respect to a portion on the rear side of the lower portion of the fixing surface portion 101*a* of the lower support bracket 101.

The upper support bolt 144 penetrates the support arm 146 fixed to the upper support bracket 143, penetrates the arc-shaped guide hole 143*a*, and is screwed into the upper support projecting piece 82*c*. The guide hole 143*a* has a shape along an arc around an axial center position of the lower support bolt 172, which is a rotation center of the rotation support portion of the compressor 82, and allows the upper support bolt 144 to move with respect to the upper support bracket 143 as the compressor 82 rotates.

As illustrated in FIG. 10, the support arm 146 has an upper portion that extends to the left side (a back side in FIG. 10) along the axial direction of the upper support bolt 144, and penetrates the guide bolt 147 on the left side of the upper support bracket 143. The guide bolt 147 is disposed in parallel to the upper support bracket 143. The guide bolt 147 is disposed along a direction orthogonal to the axial direction of the upper support bolt 144 in the plan view, penetrates a locking surface portion 148 extending from the rear end portion of the upper support bracket 143 leftward, and has a head portion 147*a* locked to the rear side of the locking surface portion 148. The guide bolt 147 penetrates the locking surface portion 148 by a recessed portion 148*a* (refer to the recessed portion 123*a* in FIG. 8) which is formed in the locking surface portion 148 and is opened upward. A positioning nut 149 is screwed onto the guide bolt 147 on the rear side of the support arm 146.

According to the support configuration of the compressor 82 having the above-described configuration, by loosening the fastening of the rotation support portion by the lower support bolt 172, the lower support bracket 141 and the compressor 82 supported by the lower support bracket 141 may integrally rotate about the lower support bolt 172. In this state, the support arm 146 on the guide bolt 147 is moved by an operation performed on the guide bolt 147 in the movable support portion, and the positions of the compressor 82 and the lower support bracket 141 in the rotation direction (refer to an arrow A2 in FIG. 10) around the lower support bolt 172 are adjusted.

As the position of the support arm 146 on the guide bolt 147 is adjusted, the upper support bolt 144 moves along the arc shape of the guide hole 143*a*, and the guide bolt 147 moves up and down along the recessed portion 148*a* of the locking surface portion 148. Tension of the second belt 99 is adjusted by adjusting the rotational position of the compressor 82. Note that an adjustable angular range of the rotation of the compressor 82 is, for example, approximately 20 degrees to 30 degrees.

Figure 4:
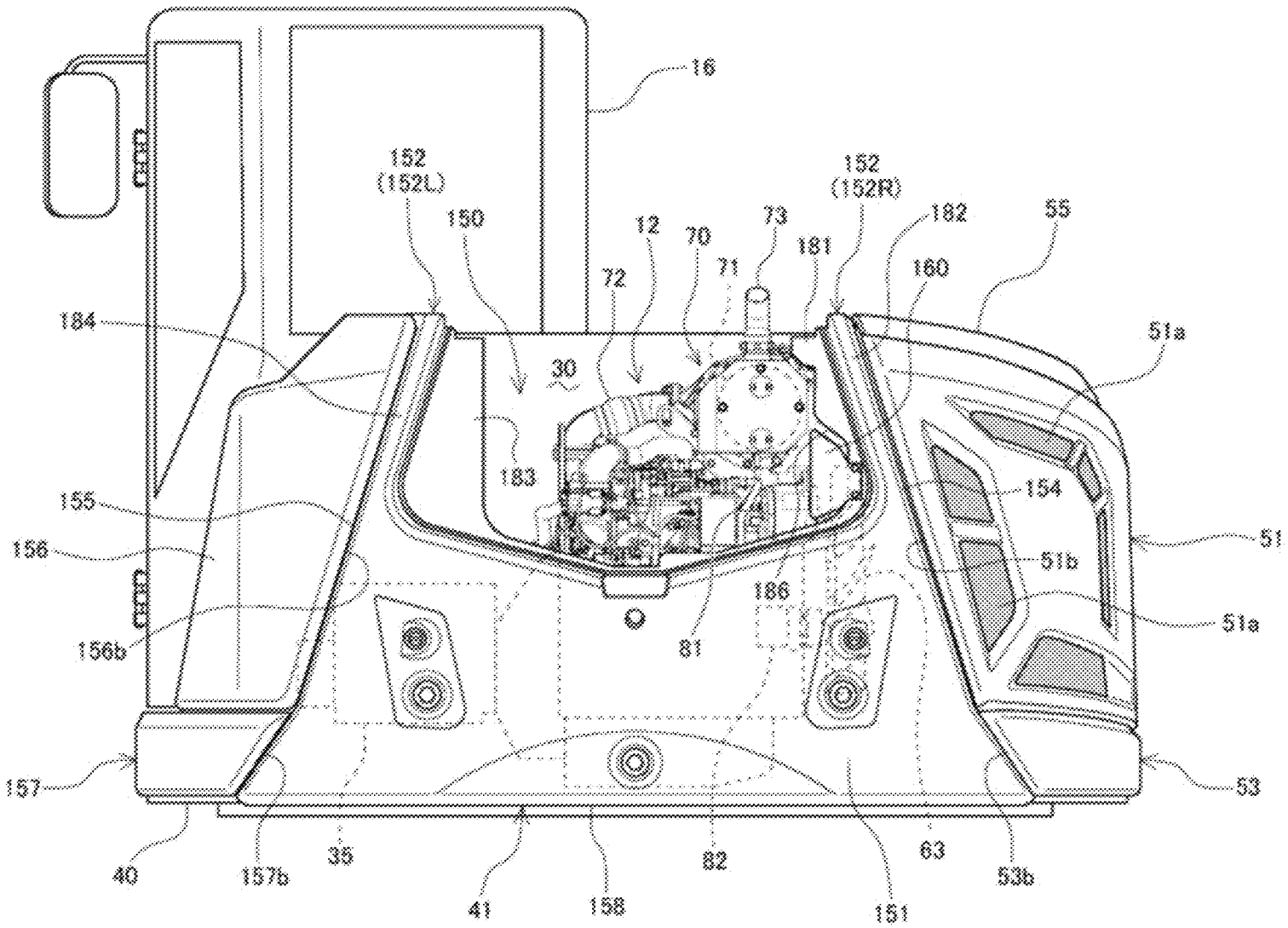
FIG. 4 is a rear view of an upper swivel body according to the embodiment of the present disclosure.
Figure 11:
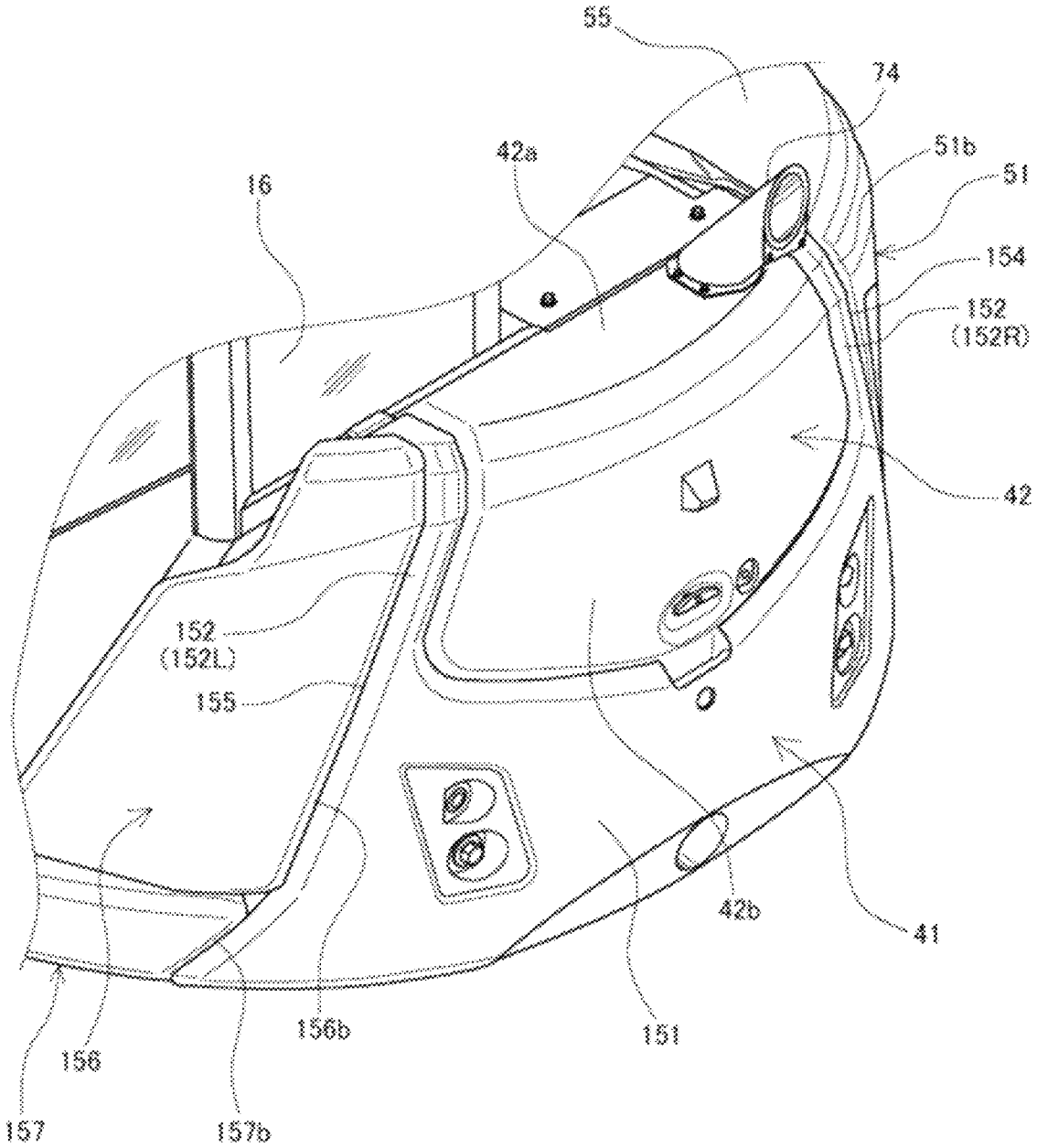
FIG. 11 is a perspective view of a rear portion of the upper swivel body according to the embodiment of the present disclosure.
Figure 12:
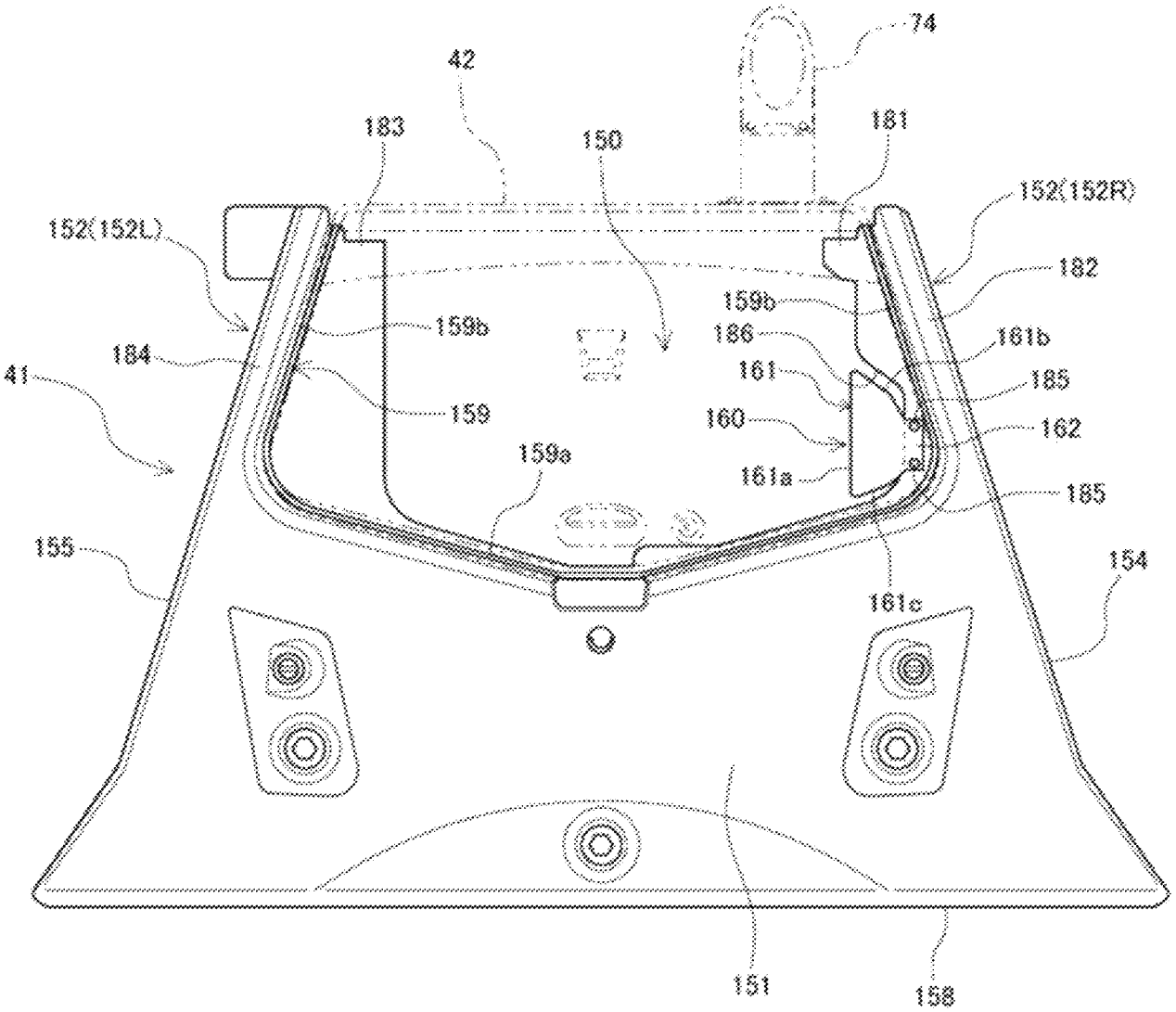
FIG. 12 is a rear view of a counterweight and a hood according to the embodiment of the present disclosure.

Next, regarding the arrangement of the alternator 81 and the compressor 82, the relationship with the counterweight 41 and the hood 42 will be described with reference to FIGS. 4, 11, and 12.

As described above, the engine 12 is installed in the engine room 30 installed in the rear portion of the machine body. The excavation work machine 1 includes the counterweight 41 as a shielding portion and the hood 42 as a cover body in a rear portion of the upper swivel body. The counterweight 41 and the hood 42 are configured to be bilaterally symmetrical or substantially bilaterally symmetrical.

The counterweight 41 has an opening portion 150 that covers the engine room 30 from the rear side and exposes the engine room 30 to the outside. The counterweight 41 includes a shielding main body portion 151 having a substantially trapezoidal outer shape in a rear view of the machine body, and projecting portions 152 extending upward from both left and right ends of the shielding main body portion 151 and forming the opening portion 150 together with the shielding main body portion 151.

In the counterweight 41, a right edge portion of the shielding main body portion 151 and a right edge portion of the right projecting portion 152R which is the right projecting portion 152 are linearly continued to each other to form a right edge portion 154 of the counterweight 41. The right edge portion 154 of the counterweight 41 abuts on an edge portion 51*b* on the rear side of the right rear cover 51. Furthermore, a lower end portion of the right edge portion 154 of the counterweight 41 abuts on the rear edge portion 53*b* of the lower right cover 53.

In the counterweight 41, a right edge portion of the shielding main body portion 151 and a right edge portion of the left projecting portion 152L which is the left projecting portion 152 are linearly continued to each other to form a left edge portion 155 of the counterweight 41. The left edge portion 155 of the counterweight 41 abuts on an edge portion 156*b* on the rear side of a left rear cover 156 which is an exterior cover disposed on the left rear side of the cabin 16. Furthermore, a lower edge portion of the left edge portion 155 of the counterweight 41 abuts on a rear edge portion 157*b* of the lower left cover 157 that is an exterior cover. The lower left cover 157 is disposed so as to be continuous with the lower side of the left side surface portion of the cabin 16, and is configured so as to be substantially bilaterally symmetrical to the lower right cover 53.

Furthermore, a lower edge portion of the shielding main body portion 151 forming a lower portion of the counterweight 41 serves as a lower edge portion 158 of the counterweight 41. The lower edge portion 158 of the counterweight 41 is horizontal and extends along the base plate 40. In the counterweight 41, in a rear view, the right edge portion 154 and the left edge portion 155 are inclined from the lower side to the upper side such that intervals therebetween (intervals in the lateral direction) are gradually narrowed, and the counterweight 41 has an outer shape along a substantially trapezoidal shape having the lower edge portion 158 as a base portion as a whole.

In the counterweight 41, the opening portion 150 is formed by the shielding main body portion 151 and the left and right projecting portions 152. That is, the opening portion 150 is formed to have a substantially "U" shape in the rear view by an upper edge portion of the shielding main body portion 151, a left edge portion of the right projecting portion 152R, and a right edge portion of the left projecting portion 152L. The opening portion 150 allows the engine room 30 to communicate with the outside in a state where the hood 42 is opened.

The opening portion 150 opens most of a substantially upper half portion of the counterweight 41 in the vertical direction. In the rear view, the upper portion of the engine 12 and the exhaust gas purification device 70 are positioned within the opening portion 150. In the counterweight 41, the shielding main body portion 151 covers the lower portion of the engine 12 from the rear side, and the right and left projecting portions 152 are positioned on the right and left sides of the upper portion of the engine 12 in the rear view.

The hood 42 is disposed so as to cover the opening portion 150 of the counterweight 41 in an openable and closable manner. As shown in FIG. 11, the hood 42 has an upper surface portion 42*a* and a covering main body portion 42*b* which is a rear surface portion and which covers substantially the entire opening portion 150. The hood 42 is disposed so as to be rotatable about a hinge (not illustrated) disposed at a front portion of the upper surface portion 42*a* with the machine body lateral direction as a rotation axis direction. When the hood 42 is rotated upward from a closed state, the opening portion 150 is entirely opened (refer to an arrow B1 in FIG. 1). The hood 42 is disposed so as to be opened to a rotational position at which at least the lower end of the hood 42 is positioned above the upper surface portion 42*a* of the hood 42 in a closed state. Note that, in FIG. 1, the hood 42 in an open state is indicated by a two dot chain line.

In a closed state, the hood 42 is fitted to a step portion 159 formed around the opening portion 150 along an outer shape of the hood 42 in the counterweight 41, and constitutes a rear wall surface portion integrated with the counterweight 41. As illustrated in FIG. 12, the step portion 159 has a lower side portion 159*a* formed in a substantially V shape in the rear view along the lower edge portion of the covering main body portion 42*b* of the hood 42, and left and right inclined side portions 159*b* formed in an inclined shape along the left edge portion 155 and the right edge portion 154 of the right and left projecting portions 152, respectively, in the rear view along the right and left edge portions of the covering main body portion 42*b*. A seal member formed of rubber or the like and disposed along the stepped portion 159 is interposed between the counterweight 41 and the hood 42.

As described above, in the configuration including the counterweight 41 and the hood 42, the alternator 81 is disposed at a position where at least a part of the alternator 81 overlaps the opening range of the opening portion 150 in the rear view of the machine body. Specifically, as illustrated in FIG. 4, the alternator 81 is located on the lower right side of the opening portion 150 in the rear view, and most of the upper side of the alternator 81 is located in the opening range of the opening portion 150. Specifically, the alternator 81 is disposed such that an intermediate portion of a right half portion of an upper edge portion of the shielding main body portion 151 is positioned at a lower portion in the rear view.

A lower end portion of the alternator 81 is covered by the shielding main body portion 151 of the counterweight 41 in the rear view. Furthermore, a right end portion of the alternator 81 is covered by the shielding main body portion 151 and a shielding plate 160 attached to the counterweight 41 as described later in the rear view.

In addition, the compressor 82 is disposed at a position where at least a portion of the compressor 82 overlaps the counterweight 41 in the rear view of the machine body. In this embodiment, the compressor 82 is positioned below the alternator 81, and as illustrated in FIG. 4, is disposed at a position where the entire compressor 82 overlaps the counterweight 41 in the rear view. The compressor 82 is positioned in front of a vertically intermediate portion of the right half portion of the shielding main body portion 151, and is disposed at a position where the entire compressor 82 is covered by the shielding main body portion 151 from the rear side.

Furthermore, the exhaust gas purification device 70 is disposed such that the entire DPF case 71 is positioned within the opening range of the opening portion 150 in the rear view. Therefore, in a state where the hood 42 is opened, the entire DPF case 71 disposed with the mounting plate 71*c* facing the rear side is exposed from the opening portion 150.

The counterweight 41 is includes the shielding plate 160 that covers a portion of the opening portion 150. The shielding plate 160 will be described with reference to FIGS. 4 and 12 to 14.

The shielding plate 160 is an example of a protection member which closes a part of the opening portion 150, and functions as a fan guard for the fan 63 which is partially exposed from the opening portion 150. The shielding plate 160 is detachably disposed on the counterweight 41. The shielding plate 160 is disposed such that at least a part thereof overlaps a space 170 (refer to FIG. 6) between the engine 12 and the fan 63 in the rear view of the machine body in the configuration in which the fan 63 disposed on the right side which is one side in the lateral direction of the engine 12 is disposed in the engine room 30.

The shielding plate 160 is disposed on the right projecting portion 152R among the right and left projecting portions 152 included in the counterweight 41. In the engine room 30, the engine 12 is installed at a substantially central portion in the lateral direction of the machine body, and the fan 63 is disposed on the right side of the engine 12. Therefore, the fan 63 is disposed at a position on the right side in the engine room 30. The shielding plate 160 is attached to the right projecting portion 152R among the right left projecting portions 152 on the side where the fan 63 is located in the lateral direction.

In detail, in the rear view, an upper end portion of the fan 63 is positioned in the vicinity of a corner portion on the lower right side formed by the shielding main body portion 151 and the right projecting portion 152R in the opening portion 150. That is, the fan 63 is disposed such that most of the lower side other than the upper end portion in the rear view is hidden by the shielding main body portion 151 of the counterweight 41. In addition, the fan 63 is positioned on the right side with respect to the right side surface portion of the engine 12 at a predetermined interval via the shaft support portion. Thus, the space 170 is present as a gap between the engine 12 and the fan 63 (refer to FIG. 6).

In such an arrangement configuration of the fan 63 with respect to the engine 12, the shielding plate 160 is disposed on the right projecting portion 152R located in the vicinity of the fan 63 in the rear view. The shielding plate 160 is provided so as to cover the portion between the engine 12 and the upper end portion of the fan 63 in the space 170 between the engine 12 and the fan 63 from the rear side. That is, the shielding plate 160 is disposed in the vicinity of a corner portion on the lower right side of the opening portion 150 formed by the shielding main body portion 151 and the right projecting portion 152R. In this embodiment, the shielding plate 160 is disposed so as to cover a portion between the alternator 81 disposed on the upper right side of the engine 12 and the upper end portion of the fan 63 from the rear side.

The shielding plate 160 is a plate-shaped member having a predetermined shape, and includes a shielding plate main body portion 161 which functions as a covering portion which partially closes a lower right portion of the opening portion 150, and a fixing surface portion 162 which is a fixing portion of the shielding plate 160 with respect to the counterweight 41. The fixing surface portion 162 is formed on a right side of the shielding plate main body portion 161. Therefore, in the shielding plate 160, the fixing surface portion 162 is fixed to the right projecting portion 152R, and the shielding plate main body portion 161 extends leftward from the right projecting portion 152R.

The shielding plate main body portion 161 has a linear left edge end portion 161*a* along the vertical direction, and an inclined upper edge end portion 161*b* and a lower edge end portion 161*c*, and has a substantially trapezoidal shape with these edge end portions with the left edge end portion 161*a* side as a bottom side in the rear view. That is, the shielding plate main body portion 161 has a shape in which a size in the vertical direction is gradually increased from the right side to the left side as a covering shape for the opening portion 150.

The fixing surface portion 162 is formed as a projecting piece having an outer shape along a rectangular shape whose longitudinal direction is the vertical direction from an intermediate portion in the vertical direction on the right side of the shielding plate main body portion 161.

A shielding plate mounting portion 180 to which the shielding plate 160 is fixed is disposed on the right projecting portion 152R. The shielding plate attachment portion 180 is disposed on an inner side (left side) of a base portion of the right projecting portion 152R. The shielding plate attachment portion 180 is formed at a lower end portion of a protruding portion 181 formed on left and right inner sides (left side) of the right projecting portion 152R in the lateral direction. The protruding portion 181 protrudes to the left and right inner sides so as to narrow the opening portion 150 at a position on the back side (front side) with respect to a ridge portion 182 so as to form the inclined side portion 159*b* of the stepped portion 159 together with the right ridge portion 182 forming an upper portion of the right edge portion 154 of the counterweight 41 in the right projecting portion 152R.

The protruding portion 181 of the right projecting portion 152R receives the hood 42 in the counterweight 41 together with the protruding portion 183 of the left projecting portion 152L. The left protruding portion 183 protrudes to the left and right inner sides (right side) so as to narrow the opening portion 150 at a position on the back side (front side) with respect to a ridge portion 184 so as to form the inclined side portion 159*b* of the stepped portion 159 together with the right ridge portion 184 forming an upper portion of the left edge portion 155 of the counterweight 41 in the left projecting portion 152L. The left protruding portion 183 is formed to be wider as a whole than the right protruding portion 181. The left and right protruding portions 181 and 183 are covered by the hood 42 in the closed state.

Figure 13:
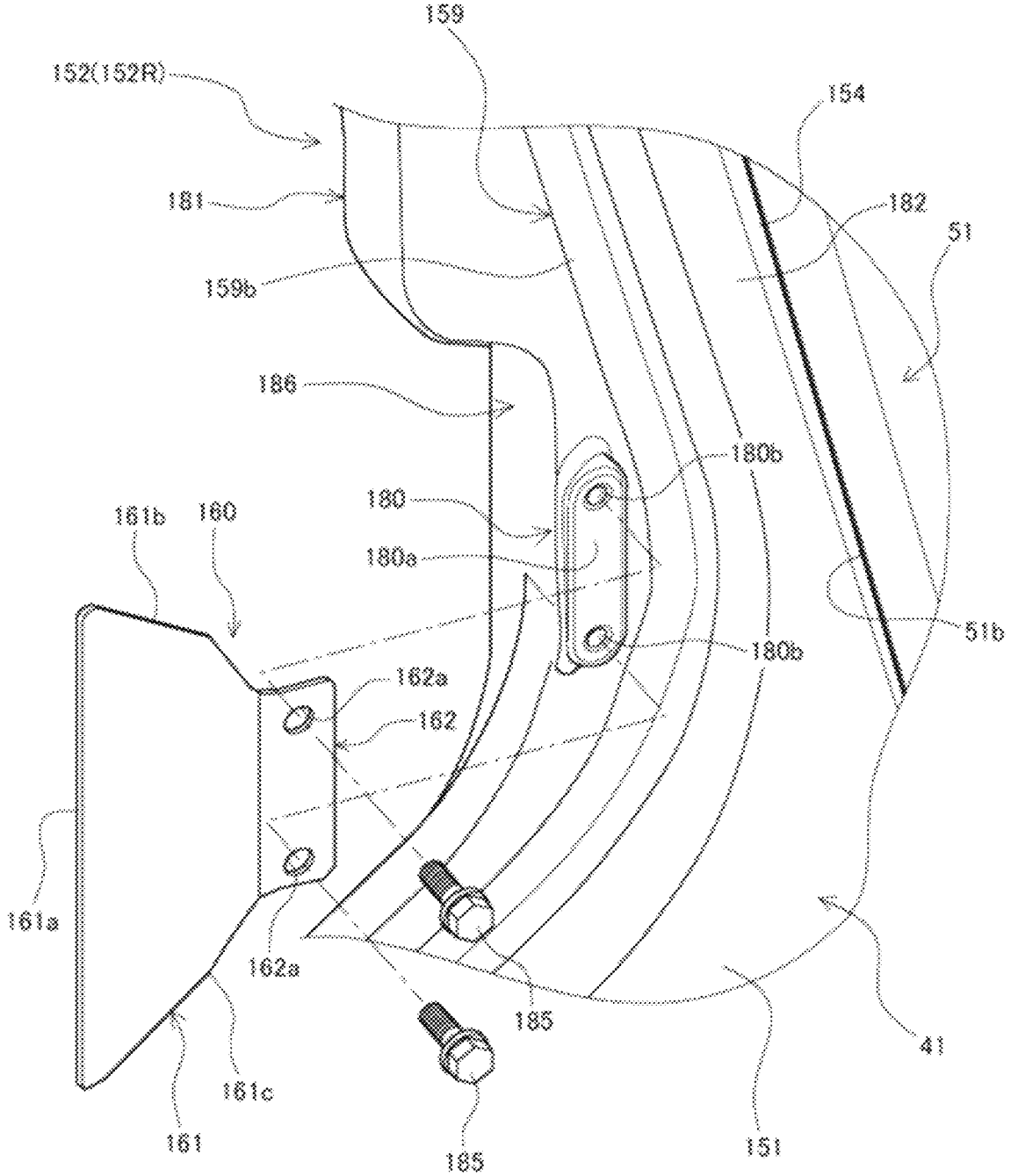
FIG. 13 is an exploded perspective view of a mounting structure of a shielding plate according to the embodiment of the present disclosure.
Figure 14:
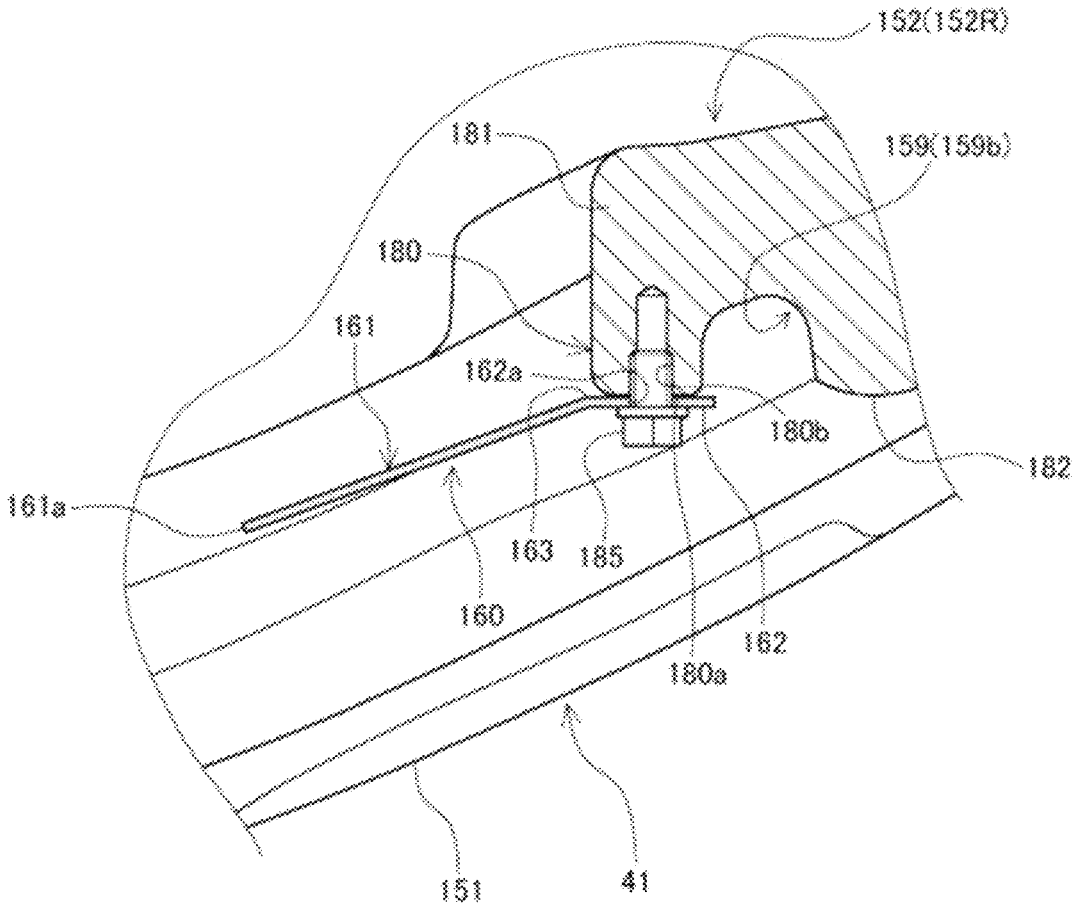
FIG. 14 is a plan cross-sectional view showing the mounting structure of the shielding plate according to the embodiment of the present disclosure.

As illustrated in FIGS. 13 and 14, the shielding plate mounting portion 180 is a rearward projecting portion having a rectangular shape whose longitudinal direction is the vertical direction, and forms a pedestal portion for mounting the shielding plate 160. The shielding plate attachment portion 180 has a flat support surface 180*a* that supports the fixing surface portion 162 of the shielding plate 160. The support surface 180*a* is a vertical flat surface facing rearward.

In the shielding plate 160, the fixing surface portion 162 is fixed to the shielding plate mounting portion 180 at two upper and lower positions by mounting bolts 185. In the shielding plate mounting portion 180, screw holes 180*b* into which the mounting bolts 185 are screwed are opened at two positions, that is, upper and lower positions, so as to face the support surface 180*a*. A hole portion 162*a* through which the mounting bolts 185 penetrates is formed in the fixing surface portion 162.

In a state where the shielding plate 160 is attached to the counterweight 41, the fixing surface portion 162 is brought into contact with the support surface 180*a* of the shielding plate attachment portion 180 as a surface contact, and a plate thickness direction of the fixing surface portion 162 is the front-rear direction (the vertical direction in FIG. 14). In the attached state of the shielding plate 160, the shielding plate main body portion 161 is inclined in a plan view so that the left edge end portion 161*a* of the shielding plate main body portion 161 is positioned on a left rear side with respect to the fixing surface portion 162 (refer to FIG. 14). The shielding plate main body portion 161 is inclined along the inclination of the shielding main body portion 151 of the counterweight 41 which has a curved shape protruding rearward in a plan view.

As illustrated in FIG. 14, the shielding plate 160 has a bent shape in a plan view formed by the shielding plate main body portion 161 and the fixing surface portion 162, and forms a linear ridge line portion 163 extending in the vertical direction. That is, the shielding plate 160 is a bent plate-like member having a constant thickness and formed by the shielding plate main body portion 161 and the fixing surface portion 162. An angle formed by the shielding plate main body portion 161 and the fixing surface portion 162 in the plan view is, for example, approximately 160 degrees.

On the counterweight 41 side, a recessed portion 186 that positions the shielding plate main body portion 161 of the shielding plate 160 is formed in the protruding portion 181 of the right projecting portion 152R. The recessed portion 186 is formed by cutting out a lower portion of the protruding portion 181 in the rear view, and has a substantially trapezoidal recessed shape along an outer shape of the shielding plate main body portion 161. The recessed portion 186 is formed so as to be entirely closed by the shielding plate main body portion 161 while forming a clearance with respect to each of the upper edge end portion 161*b* and the lower edge end portion 161*c* of the shielding plate main body portion 161 of the shielding plate 160 in the rear view.

The recessed portion 186 forms a recessed opening portion which is closed by the shielding plate 160 in the opening portion 150 at the lower right corner portion of the opening portion 150. That is, in a state where the hood 42 is opened and the opening portion 150 is opened, the recessed portion 186 serves as an opening portion that allows the engine room 30 to communicate with the outside when the shielding plate 160 is removed. Therefore, the recessed portion 186 is formed so that a portion between the engine 12 and the upper end portion of the fan 63 in the space 170 between the engine 12 and the fan 63 overlaps with the opening range of the recessed portion 186 in the rear view.

The recessed portion 186 secures a work space for maintenance in a state where the shielding plate 160 is removed. That is, the recessed portion 186 is opened to secure a space for accessing a maintenance target in the engine room 30. As the maintenance performed through the recessed portion 186, for example, the tension of the first belt 95 is adjusted by rotating the alternator 81 as described above.

According to the excavation work machine 1 of this embodiment as described above, in the configuration including the exhaust gas purification device 70, it is possible to obtain favorable maintainability of devices, such as the alternator 81 disposed near the engine 12, and to efficiently dispose the devices in the engine room 30.

As an arrangement configuration of devices in the engine room 30, the alternator 81 is disposed at a position behind the engine 12 and below the exhaust gas purification device 70. According to such a configuration, for example, as compared with a configuration in which the alternator 81 is disposed on the front side of the engine 12, the alternator 81 is disposed at a position easily accessible from the rear side of the machine body. Therefore, it is possible to obtain favorable maintainability of the alternator 81. In particular, since the rear side of the engine room 30 is opened by the opening portion 150 when the hood 42 is opened, the alternator 81 disposed on the rear side of the engine 12 is easily accessible and can be easily maintained.

In addition, since the exhaust gas purification device 70, which is relatively bulky and heavy, is disposed above the engine 12 on a side opposite to a side on which the hydraulic pump 35 is disposed, a well-balanced and efficient equipment layout can be achieved in the engine room 30.

Furthermore, as a device layout in the engine room 30, the hydraulic pump 35 which is a relatively small device is installed in a space on one of the left and right sides (left side) with respect to the engine 12 and the exhaust gas purification device 70 which are relatively bulky, and the operation section 10 in the cabin 16 is disposed on an upper front side of the installation space of the hydraulic pump 35. With this configuration, it is possible to avoid reduction of a room for the operation section 10 due to the space required in the engine room 30, and it becomes easy to secure the space of the operation section 10, so it is possible to realize a comfortable operation space. In particular, in a relatively small shovel, such as the excavation work machine 1, the space of the engine room 30 is limited. Therefore, according to the device layout in the engine room 30 according to the present embodiment, it is possible to effectively suppress the space of the operation section 10 from being reduced, and it is possible to easily balance the weight between the left and right sides of the machine body.

The compressor 82 is disposed below the alternator 81 as the arrangement configuration of the devices included in the engine room 30. With this configuration, for example, as compared with a configuration in which the compressor 82 is disposed on the front side of the engine 12, the compressor 82 is disposed at a position easily accessible from the rear side of the machine body. Therefore, it is possible to obtain favorable maintainability of the compressor 82. In particular, since the rear side of the engine room 30 is opened by the opening portion 150 when the hood 42 is opened, the compressor 82 disposed on the rear side of the engine 12 is easily accessible and can be easily maintained.

Furthermore, since the compressor 82 is disposed below the alternator 81, these devices are positioned in the vicinity of each other, so that the work efficiency of the maintenance work for both the devices can be improved.

Furthermore, at least a portion of the compressor 82 is positioned behind the alternator 81. With this configuration, the compressor 82 can be disposed at a more easily accessible position, and good maintainability can be obtained.

The counterweight 41 having the opening portion 150 and the hood 42 for opening and closing the opening portion 150 are disposed as a configuration forming a rear wall portion of the engine room 30, the alternator 81 is disposed so that a part thereof is exposed from the opening portion 150, and the compressor 82 is disposed at a position where the whole thereof is covered by the counterweight 41. With this configuration, the alternator 81 and the compressor 82 can be disposed at a more easily accessible position, and good maintainability can be obtained for these devices.

In addition, the cylindrical DPF case 71 is disposed above the engine 12 in a direction in which the central axis direction thereof is the front-rear direction or the substantially front-rear direction. With this configuration, for example, when compared with a configuration in which the DPF case 71 is installed vertically (in a direction in which the central axis direction is the vertical direction) or a configuration in which the DPF case 71 is disposed on the front side of the engine 12, the DPF case 71 is disposed at a position which is easily accessed from the rear side of the machine body, and thus it is possible to obtain favorable maintainability of the DPF case 71.

In particular, according to the configuration in which the DPF case 71 is installed such that the mounting plate 71*c* faces the rear side, by opening the hood 42, it is possible to easily perform replacement work or the like of the filter of the DPF case 71 from the opening portion 150. In addition, according to the configuration in which the mounting plate 71*c* of the DPF case 71, the alternators 81, and the compressors 82 are arranged vertically in the rear view, these devices can be arranged in a concentrated manner, and the workability of the maintenance work can be improved.

In addition, according to the configuration in which the DPF case 71 is disposed along the front-rear direction above the engine 12, it is possible to effectively use the space in the engine room 30, and it is possible to effectively reduce a situation in which a room of the operation section 10 is reduced by the space required in the engine room 30. As a result, the space of the operation section 10 is easily secured, and the comfort of the operation section 10 can be improved.

Furthermore, the alternator 81 is supported in a rotatable manner to adjust the tension of the first belt 95. With this configuration, it is possible to easily perform an operation of adjusting the tension of the first belt 95 as a maintenance operation for the alternator 81 disposed at a position which is easily accessible from the rear side of the machine body, and it is possible to obtain favorable maintainability.

Furthermore, the counterweight 41 has the shielding plate 160 disposed so as to shield the space between the engine 12 and the fan 63 from the rear side. With this configuration, when maintenance is performed on the apparatuses and devices included in the engine room 30, an access path to the fan 63 can be closed. Therefore, it is possible to prevent the fan 63 from being caught, and it is possible to secure safety.

The shielding plate 160 is attached to the right projecting portion 152R of the counterweight 41. With this configuration, the shielding plate 160 can be provided with a simple configuration without separately providing a support member of the shielding plate 160.

In addition, the shielding plate 160 is disposed so as to close the recessed portion 186 formed in the protruding portion 181 disposed in the right projecting portion 152R. With this configuration, it is possible to minimize the opening range of the opening portion 150 on the side (right side) in which the fan 63 is arranged while ensuring accessibility to the fan 63 and the devices arranged in the vicinity thereof with the recessed portion 186 by removing the shielding plate 160. Thus, it is possible to easily balance the weight of the entire machine body, which is relatively largely affected by the shape of the counterweight 41 and the like. In addition, since the opening range of the opening portion 150 is narrowed, noise, such as driving sound of the engine 12 in the engine room 30, can be reduced.

The work machine according to the present disclosure described in the embodiment above is not limited to the above-mentioned embodiment, and various modes can be adopted to the extent within the scope of the gist of the present disclosure.

The present technique may have the following configurations. Note that the configurations described below can be selected, omitted, and arbitrary combined.

(1)

A work machine comprising:

an engine having an output shaft projecting to one side in a lateral direction of a machine body;

a hydraulic pump disposed on the other side in the lateral direction of the engine;

an exhaust treatment device disposed above the engine and treating exhaust gas discharged from the engine; and an alternator driven by rotational power of the output shaft, wherein the alternator is disposed at a position behind the engine and below the exhaust treatment device.

(2)

The work machine according to (1), further comprising a compressor driven by the rotational power of the output shaft and disposed below the alternator.

(3)

The work machine according to (2), wherein at least a part of the compressor is positioned behind the alternator in the machine body.

(4)

The work machine according to (2) or (3), wherein the engine is installed in an engine room disposed in a rear portion of the machine body, the work machine further includes a shielding portion that covers the engine room from a rear side and has an opening portion that exposes the engine room to an outside, and a cover body that covers the opening portion in an openable/closable manner, the alternator is disposed at a position at which at least a portion of the alternator overlaps an opening range of the opening portion in a rear view of the machine body, and the compressor is disposed at a position at which at least a portion of the compressor overlaps the shielding portion in a rear view of the machine body.

(5)

The work machine according to any one of (1) to (4), wherein the exhaust treatment device includes a cylindrical filter case into which exhaust gas discharged from the engine is introduced, and the filter case is disposed in a direction in which a longitudinal direction of the filter case is a front-rear direction of the machine body.

(6)

The work machine according to (5), wherein the alternator is disposed in a state in which one end side of the alternator is supported in a rotatable manner on the engine, and the other end side of the alternator is fixed to and supported by a support bracket extending from a support member supporting the exhaust treatment device with respect to the engine toward the rear of the machine body in a position changeable manner to allow rotation of the alternator.

(7)

The work machine according to (4), further comprising:

a fan disposed on one side of the engine in the lateral direction; and a protection member detachable from the shielding portion and shielding a part of the opening portion, wherein the protection member is disposed such that at least a part of the protection member overlaps a space between the engine and the fan in the rear view of the machine body.

(8)

The work machine according to (7), wherein the shielding portion includes a shielding main body portion forming a lower portion of the shielding portion and projecting portions extending upward from both left and right ends of the shielding main body portion and forming the opening portion together with the shielding main body portion, and the protection member is disposed for one of the left and right projecting portions.

REFERENCE SIGNS LIST

1 excavation work machine (work machine)
12 engine
30 engine room
35 hydraulic pump
41 counterweight (shielding portion)
42 hood (cover body)
63 fan
65 output shaft
70 exhaust gas purification device (exhaust treatment device)
71 DPF case (filter case)
76 rear support stay (support member)
81 alternator
82 compressor
100 upper support bracket (support bracket)
150 opening portion
151 shielding main body portion
152 projecting portion
160 shielding plate (protection member)
170 space
181 protruding portion
186 recessed portion

The invention claimed is:

1. A work machine comprising:

an engine having an output shaft projecting to one side in a lateral direction of a machine body;

a hydraulic pump disposed on the other side in the lateral direction of the engine;

an exhaust treatment device disposed above the engine and treating exhaust gas discharged from the engine; and a compressor driven by the rotational power of the output shaft, an alternator driven by rotational power of the output shaft, wherein the alternator is disposed at a position behind the engine and below the exhaust treatment device, and a rotation shaft of the compressor is disposed below an entirety of the alternator.

2. The work machine according to claim 1, wherein at least a part of the compressor is positioned behind the alternator in the machine body.

3. The work machine according to claim 1, wherein the engine is installed in an engine room disposed in a rear portion of the machine body, the work machine further includes a shielding portion that covers the engine room from a rear side and has an opening portion that exposes the engine room to an outside, and a cover body that covers the opening portion in an openable/closable manner, the alternator is disposed at a position at which at least a portion of the alternator overlaps an opening range of the opening portion in a rear view of the machine body, and the compressor is disposed at a position at which at least a portion of the compressor overlaps the shielding portion in a rear view of the machine body.

4. The work machine according to claim 1, wherein the exhaust treatment device includes a cylindrical filter case into which exhaust gas discharged from the engine is introduced, and the filter case is disposed in a direction in which a longitudinal direction of the filter case is a front-rear direction of the machine body.

5. The work machine according to claim 4, wherein the alternator is disposed in a state in which one end side of the alternator is supported in a rotatable manner on the engine, and the other end side of the alternator is fixed to and supported by a support bracket extending from a support member supporting the exhaust treatment device with respect to the engine toward rear of the machine body in a position changeable manner to allow rotation of the alternator.

6. The work machine according to claim 3, further comprising:

a fan disposed on one side of the engine in the lateral direction; and a protection member detachable from the shielding portion and shielding a part of the opening portion, wherein the protection member is disposed such that at least a part of the protection member overlaps a space between the engine and the fan in the rear view of the machine body.

7. The work machine according to claim 6, wherein the shielding portion includes a shielding main body portion forming a lower portion of the shielding portion and projecting portions extending upward from both left and right ends of the shielding main body portion and forming the opening portion together with the shielding main body portion, and the protection member is disposed for one of the left and right projecting portions.

* * * * *